US012167766B2

(12) United States Patent
Hollinger et al.

(10) Patent No.: US 12,167,766 B2
(45) **Date of Patent: *Dec. 17, 2024**

(54) GROUND-ENGAGING STRUCTURES FOR ARTICLES OF FOOTWEAR

(71) Applicant: NIKE, Inc., Beaverton, OR (US)

(72) Inventors: Kevin Hollinger, Portland, OR (US); Cheresse Thornhill, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 166 days.

This patent is subject to a terminal disclaimer.

(21) Appl. No.: 17/532,684

(22) Filed: Nov. 22, 2021

(65) Prior Publication Data

US 2022/0095738 A1 Mar. 31, 2022

Related U.S. Application Data

(63) Continuation of application No. 15/774,169, filed as application No. PCT/US2016/062722 on Nov. 18, 2016, now Pat. No. 11,206,890.
(Continued)

(51) Int. Cl.
*A43B 1/00* (2006.01)
*A43B 7/14* (2022.01)
(Continued)

(52) U.S. Cl.
CPC ..... *A43B 1/0009* (2013.01); *A43B 7/1445* (2013.01); *A43B 13/184* (2013.01);
(Continued)

(58) Field of Classification Search
None
See application file for complete search history.

(56) References Cited

U.S. PATENT DOCUMENTS 3,383,782 A * 5/1968 McGinnity ..... A43B 3/30 36/9 R
4,837,948 A 6/1989 Cho
(Continued)

FOREIGN PATENT DOCUMENTS

CN 101278772 A 10/2008
CN 104602559 A 5/2015
(Continued)

OTHER PUBLICATIONS

Feb. 22, 2017—(WO) ISR & WO—App. No. PCT/US16/062722.
Jun. 19, 2020—(EP) ESR—App. No. 20164319.4.

*Primary Examiner* — Jila M Mohandesi
(74) *Attorney, Agent, or Firm* — Banner & Witcoff, Ltd.

(57) ABSTRACT

Ground-engaging components for articles of footwear include an upper-facing surface and a ground-facing surface opposite the upper-facing surface. At least the ground-facing surface may be formed to include a matrix structure, and this matrix structure may include a plurality of open cells (e.g., in a heel region and/or an arch region) and a forefoot region including a plurality of closed forefoot support cells. The ground-engaging component may be engaged with a midsole member (e.g., including a foam midsole element and/or one or more fluid-filled bladders), and this combination may form a sole structure that is engaged with an upper to form an article of footwear.

19 Claims, 19 Drawing Sheets

Related U.S. Application Data

(60) Provisional application No. 62/258,208, filed on Nov. 20, 2015.

(51) Int. Cl.

| | |
|---|---|
| ***A43B 7/1445*** | (2022.01) |
| ***A43B 13/18*** | (2006.01) |
| ***A43B 13/20*** | (2006.01) |
| ***A43B 13/22*** | (2006.01) |
| ***A43B 13/26*** | (2006.01) |

(52) U.S. Cl.

CPC ..... *A43B 13/20* (2013.01); *A43B 13/223* (2013.01); *A43B 13/26* (2013.01)

(56) References Cited

U.S. PATENT DOCUMENTS

| | | | | |
|---|---|---|---|---|
| 5,044,096 | A * | 9/1991 | Polegato | A43B 7/125 36/3 R |
| 5,343,639 | A * | 9/1994 | Kilgore | A43B 13/183 36/35 B |
| 5,353,523 | A * | 10/1994 | Kilgore | A43B 13/20 36/35 B |
| 6,014,821 | A * | 1/2000 | Yaw | A43B 5/08 36/8.1 |
| 6,508,015 | B1 * | 1/2003 | Rauch | A43B 7/125 36/3 R |
| 6,655,048 | B2 * | 12/2003 | Moretti | A43B 7/125 36/3 R |
| 6,915,596 | B2 | 7/2005 | Grove et al. | |
| 7,010,872 | B2 | 3/2006 | Pawlus et al. | |
| 7,032,328 | B2 | 4/2006 | Wilson et al. | |
| 7,082,698 | B2 * | 8/2006 | Smaldone | A43B 13/181 36/35 R |
| 7,328,524 | B2 * | 2/2008 | Lebo | A43B 13/146 36/3 R |
| 7,716,851 | B2 * | 5/2010 | Polegato Moretti | A43B 7/125 36/59 R |
| 7,966,748 | B2 | 6/2011 | Votolato | |
| 8,186,078 | B2 * | 5/2012 | Avar | A43B 13/184 36/103 |
| 8,312,643 | B2 * | 11/2012 | Goodwin | A43B 13/181 36/35 B |
| 8,544,190 | B2 * | 10/2013 | Nishiwaki | A43B 21/265 36/31 |
| 8,656,609 | B2 * | 2/2014 | Macey | A43B 13/187 36/35 B |
| 9,351,534 | B2 * | 5/2016 | Peikert | A43B 13/12 |
| 9,402,439 | B2 | 8/2016 | Cross et al. | |
| 9,883,715 | B2 | 2/2018 | McDonald et al. | |
| 9,961,959 | B2 | 5/2018 | Gerber | |
| 11,206,890 | B2 | 12/2021 | Hollinger et al. | |
| 2005/0126036 | A1 * | 6/2005 | Wu | A43B 7/08 36/30 R |
| 2005/0172513 | A1 * | 8/2005 | Lechhart | A43B 7/125 36/3 R |
| 2005/0188562 | A1 * | 9/2005 | Clarke | A43B 3/0042 36/3 R |
| 2005/0229431 | A1 * | 10/2005 | Gerlin | A43B 13/188 36/25 R |
| 2006/0156579 | A1 | 7/2006 | Hoffer et al. | |
| 2008/0250673 | A1 | 10/2008 | Andrews et al. | |
| 2009/0277047 | A1 * | 11/2009 | Polegato Moretti | A43B 13/10 36/28 |
| 2009/0293305 | A1 * | 12/2009 | Pelsue | A43B 13/20 264/510 |
| 2010/0011624 | A1 * | 1/2010 | Polegato Moretti | A43B 7/125 12/146 B |
| 2012/0117822 | A1 | 5/2012 | Jarvis | |
| 2012/0159814 | A1 * | 6/2012 | Smith | A43B 7/14 36/76 R |
| 2012/0216423 | A1 * | 8/2012 | Lyden | A43B 3/26 36/84 |
| 2014/0109441 | A1 | 4/2014 | McDowell et al. | |
| 2014/0182170 | A1 | 7/2014 | Wawrousek et al. | |
| 2014/0202042 | A1 | 7/2014 | Berend et al. | |
| 2016/0051009 | A1 | 2/2016 | Kormann et al. | |
| 2016/0255911 | A1 | 9/2016 | Fujita et al. | |

FOREIGN PATENT DOCUMENTS

| | | | |
|---|---|---|---|
| CN | 107750134 | A | 3/2018 |
| JP | 2005304653 | A | 11/2005 |
| WO | 2005072550 | A1 | 8/2005 |
| WO | 2014100462 | A1 | 6/2014 |
| WO | 2016191269 | A1 | 12/2016 |
| WO | 2016191282 | A1 | 12/2016 |

* cited by examiner

GROUND-ENGAGING STRUCTURES FOR ARTICLES OF FOOTWEAR

RELATED APPLICATION DATA

This application is (a) a continuation of U.S. patent application Ser. No. 15/774,169 titled "Ground-Engaging Structures for Articles of Footwear and filed May 7, 2018, which application is (b) a U.S. National Phase filing of International Application No. PCT/US2016/062722, filed on Nov. 18, 2016 designating the United States of America, which application (c) claims priority to U.S. Provisional Patent Application No. 62/258,208, titled "Ground-Engaging Structures for Articles of Footwear" and filed Nov. 20, 2015. Each of these priority applications is incorporated herein by reference in its entirety.

FIELD OF THE INVENTION

The present invention relates to the field of footwear. More specifically, aspects of the present invention pertain to articles of athletic footwear and/or ground-engaging structures for articles of footwear, e.g., cleated footwear used in cricket and/or other athletic events.

Terminology/General Information

First, some general terminology and information is provided that may assist in understanding various portions of this specification and the invention(s) as described herein. As noted above, the present invention relates to the field of footwear. "Footwear" means any type of wearing apparel for the feet, and this term includes, but is not limited to: all types of shoes, boots, sneakers, sandals, thongs, flip-flops, mules, scuffs, slippers, sport-specific shoes (such as track shoes, golf shoes, tennis shoes, baseball cleats, cricket shoes, soccer or football cleats, ski boots, basketball shoes, cross training shoes, etc.), and the like.

FIG. 1 also provides information that may be useful for explaining and understanding this specification and/or aspects of this invention. More specifically, FIG. 1 provides a representation of a footwear component 100, which in this illustrated example constitutes a portion of a sole structure for an article of footwear. The same general definitions and terminology described below may apply to footwear in general and/or to other footwear components or portions thereof, such as an upper, a midsole component, an outsole component, a ground-engaging component, etc.

First, as illustrated in FIG. 1, the terms "forward" or "forward direction" as used herein, unless otherwise noted or clear from the context, mean toward or in a direction toward a forward-most toe ("FT") area of the footwear structure or component 100. The terms "rearward" or "rearward direction" as used herein, unless otherwise noted or clear from the context, mean toward or in a direction toward a rear-most heel area ("RH") of the footwear structure or component 100. The terms "lateral" or "lateral side" as used herein, unless otherwise noted or clear from the context, mean the outside or "little toe" side of the footwear structure or component 100. The terms "medial" or "medial side" as used herein, unless otherwise noted or clear from the context, mean the inside or "big toe" side of the footwear structure or component 100.

Also, various example features and aspects of this invention may be disclosed or explained herein with reference to a "longitudinal direction" and/or with respect to a "longitudinal length" of a footwear component 100 (such as a footwear sole structure). As shown in FIG. 1, the "longitudinal direction" is determined as the direction of a line extending from a rearmost heel location (RH in FIG. 1) to the forwardmost toe location (FT in FIG. 1) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight applied to the component 100 other than potentially the weight of the shoe components with which it is engaged). If the forwardmost and/or rearmost locations of a specific footwear component 100 constitute a line segment (rather than a tangent point), then the forwardmost toe location and/or the rearmost heel location constitute the mid-point of the corresponding line segment. If the forwardmost and/or rearmost locations of a specific footwear component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearwardmost locations constitute one or more areas, then the forwardmost toe location and/or the rearwardmost heel location constitute the geographic center of the area or combined areas (irrespective of whether the geographic center itself lies on the component 100 structure).

Once the longitudinal direction of a component or structure 100 has been determined with the component 100 oriented on a horizontal support surface S, planes may be oriented perpendicular to this longitudinal direction (e.g., planes running into and out of the page of FIG. 1). The locations of these perpendicular planes may be specified based on their positions along the longitudinal length L where the perpendicular plane intersects the longitudinal direction between the rearmost heel location RH and the forwardmost toe location FT. In this illustrated example of FIG. 1, the rearmost heel location RH is considered as the origin for measurements (or the "0L position") and the forwardmost toe location FT is considered the end of the longitudinal length of this component (or the "1.0L position"). Plane position may be specified based on the plane's location along the longitudinal length L (between 0L and 1.0L), measured forward from the rearmost heel RH location in this example. FIG. 1 further shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 1, and similar perpendicular planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 1.

BRIEF DESCRIPTION OF THE DRAWINGS

The following Detailed Description will be better understood when read in conjunction with the accompanying drawings in which like reference numerals refer to the same or similar elements in all of the various views in which that reference number appears.

Figure 1:
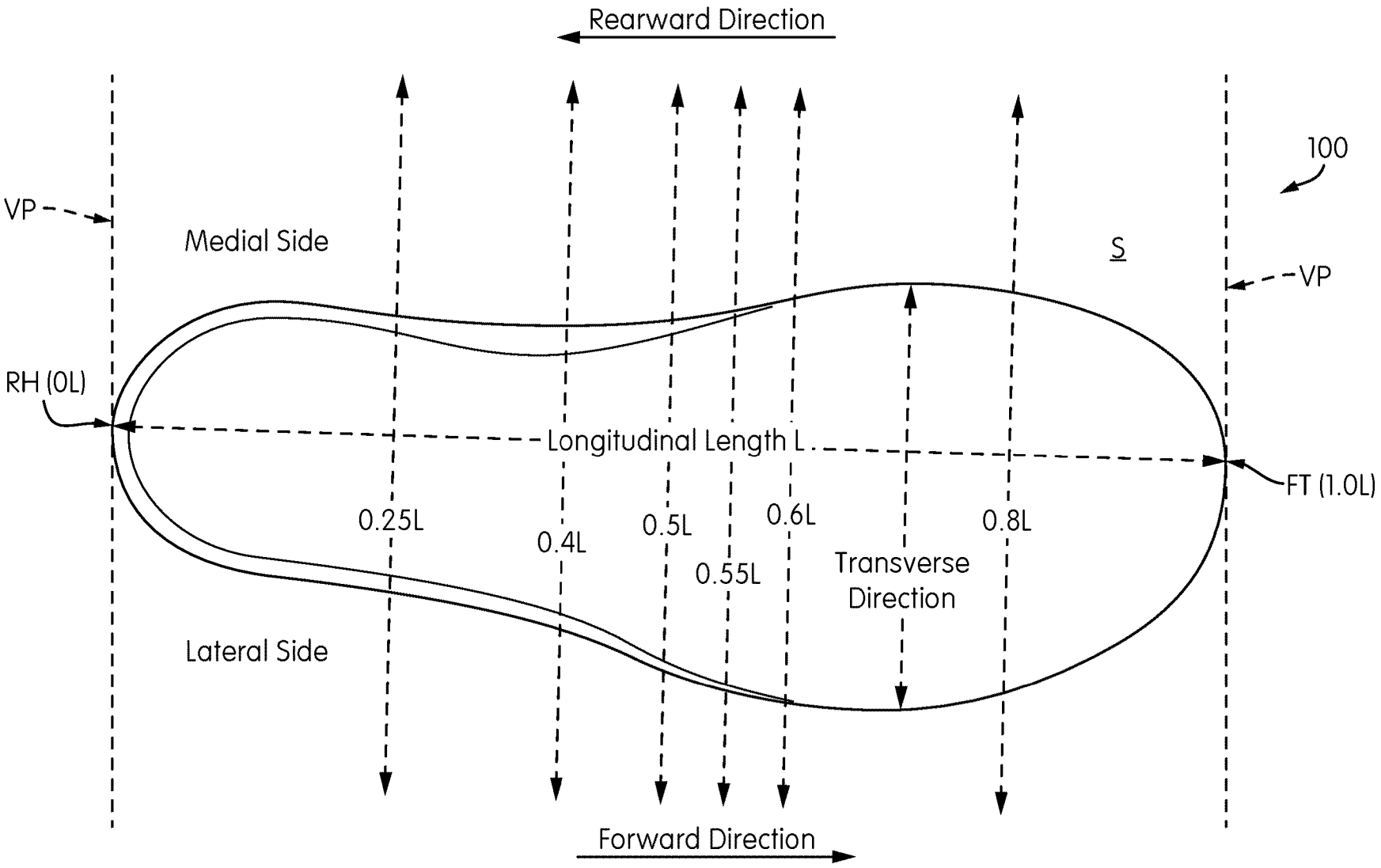
FIG. 1 is provided to help illustrate and explain background and definitional information useful for understanding certain terminology and aspects of this invention.

The reader should understand that the attached drawings are not necessarily drawn to scale.

DETAILED DESCRIPTION

In the following description of various examples of footwear structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. General Description of Aspects of this Invention

A. Ground-Engaging Components

Aspects of this invention relate to ground-engaging components for articles of footwear and articles of footwear containing such ground-engaging components. The ground-engaging components may include: (a) an upper-facing surface and (b) a ground-facing surface opposite the upper-facing surface. At least the ground-facing surface may be formed to include a matrix structure, and this matrix structure may include: (i) a plurality of open cells (e.g., a heel region including a plurality of open heel support cells, a midfoot region including a plurality of open midfoot support cells, and/or a forefoot region including a plurality of open forefoot support cells) and (ii) a forefoot region including a plurality of closed forefoot support cells.

In at least some examples of this invention, an average area enclosed by side walls of the plurality of open heel support cells may be greater than an average area enclosed by side walls of the plurality of open midfoot support cells, and/or an average area enclosed by side walls of the plurality of closed forefoot support cells may be greater than the average area enclosed by the side walls of the plurality of open midfoot support cells. As yet additional or alternative example features and/or characteristics, if desired:

(a) the heel region of the ground-engaging components may include a heel region support cell size differential ($\Delta A_H$) of:

$$\Delta A_H = A_{HL} - A_{HS},$$

wherein $A_{HL}$ is an area enclosed by side walls of a largest open heel support cell located fully in the heel region and $A_{HS}$ is an area enclosed by side walls of a smallest open heel support cell located fully in the heel region;

(b) the midfoot region of the ground-engaging components may include a midfoot region support cell size differential ($\Delta A_M$) of:

$$\Delta A_M = A_{ML} - A_{MS},$$

wherein $A_{ML}$ is an area enclosed by side walls of a largest open midfoot support cell located fully in the midfoot region and $A_{MS}$ is an area enclosed by side walls of a smallest open midfoot heel support cell located fully in the midfoot region;

(c) the forefoot region of the ground-engaging components may include a forefoot region support cell size differential ($\Delta A_F$), wherein:

$$\Delta A_F = A_{FL} - A_{FS},$$

wherein $A_{FL}$ is an area enclosed by side walls of a largest closed forefoot support cell located fully in the forefoot region and $A_{FS}$ is an area enclosed by side walls of a smallest closed forefoot heel support cell located fully in the forefoot region; and (d) $\Delta A_H \geq 2 \times \Delta A_M$ and/or $\Delta A_F \geq 2 \times \Delta A_M$. In some examples of this invention, $\Delta A_H \geq 4 \times \Delta A_M$ and/or $\Delta A_F \geq 4 \times \Delta A_M$.

As some additional or alternative potential features and/or characteristics, ground-engaging components according to at least some examples of this invention may include:

(a) a heel region including a tallest heel region sidewall ($T_H$) of sidewalls in the plurality of open heel support cells located fully in the heel region, (b) a midfoot region including a tallest midfoot region sidewall ($T_M$) of sidewalls in the plurality of open midfoot support cells located fully in the midfoot region, (c) a forefoot region including a tallest forefoot sidewall ($T_F$) of sidewalls in the plurality of closed forefoot support cells located fully in the forefoot region, and (d) $T_H \geq 2 \times T_M$ and/or $T_F \geq 2 \times T_M$. In some examples, $T_H \geq 4 \times T_M$ and/or $T_F \geq 4 \times T_M$.

As noted above, the forefoot regions of the ground-engaging components include a plurality of closed forefoot support cells. In at least some examples of this invention, the plurality of closed forefoot support cells may be closed by a cover or support plate that spans multiple cells (e.g., multiple forefoot support cells) of the matrix structure. As some more specific examples, the cover or support plate may directly contact and/or be engaged with a top surface of the matrix structure, e.g., by adhesives or cements, by molding techniques, by mechanical fasteners, etc. As another example, if desired, the matrix structure may be integrally formed with and extend from a bottom surface of the cover or support plate, e g, manufactured by molding techniques, by rapid manufacturing additive fabrication techniques, etc. As yet another option or alternative, if desired, a top surface of the matrix structure may spaced from a bottom surface of the cover or support plate, e.g., by a gap over at least a portion of a bottom surface area of the cover or support plate. If desired, the support plate or cover may extend into the midfoot and/or heel regions of the ground-engaging component structure (or separate support plates or covers may be provided in one or both of these other regions).

Ground-engaging components in accordance with some examples of this invention may include various other features and/or characteristics. For example, if desired, at least some of the plurality of open heel support cells and/or at least some of the plurality of open midfoot support cells may have openings with curved perimeters with no distinct corners. Also, while the forefoot region includes a plurality of closed forefoot support cells, the forefoot region also may include one or more open forefoot support cells, e.g., located in a forward toe support area of the forefoot region, along a medial side edge of the forefoot region, and/or along a lateral side edge of the forefoot region, etc., of the matrix structure. Additionally or alternatively, ground-engaging components in accordance with at least some examples of this invention may include a perimeter edge or rim extending around its outer perimeter, wherein the perimeter edge or rim includes area from the outer perimeter to a distance located inward 0.5 inches from the outer perimeter of the ground-engaging component, and wherein an average area of the plurality of closed forefoot support cells that make up the perimeter edge is at least 10% smaller than an average area of the plurality of closed forefoot support cells not making up the perimeter edge (and in some examples, at least 20% smaller, at least 30% smaller, or even at least 40% smaller). The perimeter edge or rim area may be completely closed and/or a top surface of the perimeter edge or rim area may form a bonding area, e.g., an area for engaging the ground-engaging component with another structure, such as a midsole component, a footwear upper, etc.; at which adhesive is applied; and/or an area to support stitches and/or fasteners.

As still some additional example features, the matrix structure of ground-engaging components in accordance with at least some examples of this invention may include or define a plurality of cleat support areas, e.g., in the forefoot region, in the heel region, etc. Such cleat support areas may include a plurality of cleats (e.g., primary traction elements) integrally formed with and extending from the matrix structure in the forefoot region and/or support hardware to which a removable cleat (e.g., a primary traction element) may be mounted (e.g., a threaded component or a turnbuckle construction to which a removable and replaceable cleat may be mounted). Secondary traction elements also may be provided as part of the matrix structure (e.g., integrally formed with the matrix structure) around these cleat support areas.

The matrix structure of ground-engaging components according to at least some examples of this invention may include a ridge defining and surrounding at least some of the plurality of open cells and/or at least some of the plurality of closed forefoot support cells. This ridge may be more evident when looking at the bottom of the matrix structure. In at least some of these structures, a cross sectional width dimension of the ridge will become smaller moving in a direction from the upper-facing surface to the ground-facing surface of the ground-engaging component.

The ridges, when present, may extend around at least some of the plurality of open cells and/or at least some of the plurality of closed forefoot support cells in a manner such that the ridge forms a polygon structure or shape around individual open cells and/or closed forefoot support cells of the matrix structure. The polygon structures or shapes may have from four to twelve sides, and in some more specific examples, may include one or more hexagons, heptagons, octagons, nonagons, and/or decagons. The polygonal shaped ridge structure may form sharp points, e.g., at one or more corners of the polygon structures, and these sharp points may function as secondary traction elements (e.g., secondary traction elements dispersed around at least some of the plurality of closed forefoot support cells and/or at least some of the open support cells (e.g., in one or more of the heel, midfoot, and/or forefoot regions)).

The ridges or other features of the matrix structure may form one or more of the plurality of closed forefoot support cells (and optionally all of the closed forefoot support cells) such that: (a) a bottom of one or more of the closed forefoot support cells is open (e.g., the area of a cell surrounded by a polygonal ridge structure is open) and (b) a cover or support plate closes a top of one or more of the closed forefoot support cells. In this manner, a top surface of the cover or support plate may form a top surface of the ground-engaging component (at least at the forefoot region of the ground-engaging component).

As some additional potential features, a rear heel perimeter area of at least some ground-engaging components according to this invention may extend upward from the upper-facing surface (and away from the ground-facing surface) to form a heel support (e.g., a perimeter heel support wall). This heel support may be formed to surround at least a portion of a wearer's heel, and it may at least partially surround and/or contain other components of a sole structure and/or an article of footwear, such as a midsole component, a footwear upper, etc. If desired, the heel support may be formed of a relatively stiff material and/or function in the manner of a heel counter structure. As yet another potential feature, if desired, the ground-engaging component may be shaped and/or contoured to include an upwardly extending medial side wall in an arch support area of the ground-engaging component.

B. Sole Structures and Articles of Footwear

Additional aspects of this invention relate to sole structures and articles of footwear. Such articles of footwear include: (a) an upper and (b) a sole structure engaged with the upper, wherein the sole structure includes a ground-engaging component of the types described above.

As some more specific examples, the sole structure may include a midsole component, e.g., located between at least a portion of the upper-facing surface of the ground-engaging component and the footwear upper. The midsole component may include at least one foam midsole element and/or at least one fluid-filled bladder, optionally, foam midsole element(s) and/or fluid-filled bladder(s) of conventional types known and used in the footwear art. Other conventional midsole components also may be used, if desired.

Alternatively, in accordance with some examples of this invention, the sole structure may include a midsole component that includes a foam midsole element and at least one fluid-filled bladder engaged with the foam midsole element. As some more specific examples, the foam midsole element may include at least one recess defined in it and/or at least one opening defined through it, and a fluid-filled bladder may be engaged with the foam midsole element in each of the recesses and/or openings. Fluid-filled bladders may be positioned at one or more of: a first metatarsal head support area of the sole structure; a fourth and/or fifth metatarsal head support area of the sole structure; a big toe support area of the sole structure; a fourth and/or fifth toe support area of the sole structure; closer to a medial side edge of the foam midsole element to which it is engaged than to a lateral side edge of the foam midsole element; closer to a lateral side edge of the foam midsole element to which it is engaged than to a medial side edge of the foam midsole element; etc. An individual sole structure in accordance with at least some examples of this invention may include from one to six individual fluid-filled bladders optionally located in the forefoot region (and in some examples, from two to four fluid-filled bladders, optionally located in the forefoot region).

As noted above, some ground-engaging components in accordance with this invention may include a cover or support plate, e.g., at least in a forefoot region (e.g., closing off the plurality of closed forefoot support cells). If desired, this cover or support plate may be made from a material that is at least partially transparent or at least partially translucent. In this manner, some portions of the sole structure and/or article of footwear may be visible through the matrix structure and/or through the cover or support plate. In examples of this invention in which the sole structure includes one or more fluid-filled bladders, at least one (and optionally all) of the fluid-filled bladders may be visible from a bottom of the sole structure through the matrix structure and/or through the cover or support plate. If desired, the fluid-filled bladder(s) may be a different color from other features of the sole structure, e.g., so that the bladder is clearly visible and discernible through the matrix structure and/or through the cover or support plate.

C. Detailed Description of Specific Examples of this Invention

Figure 2A:
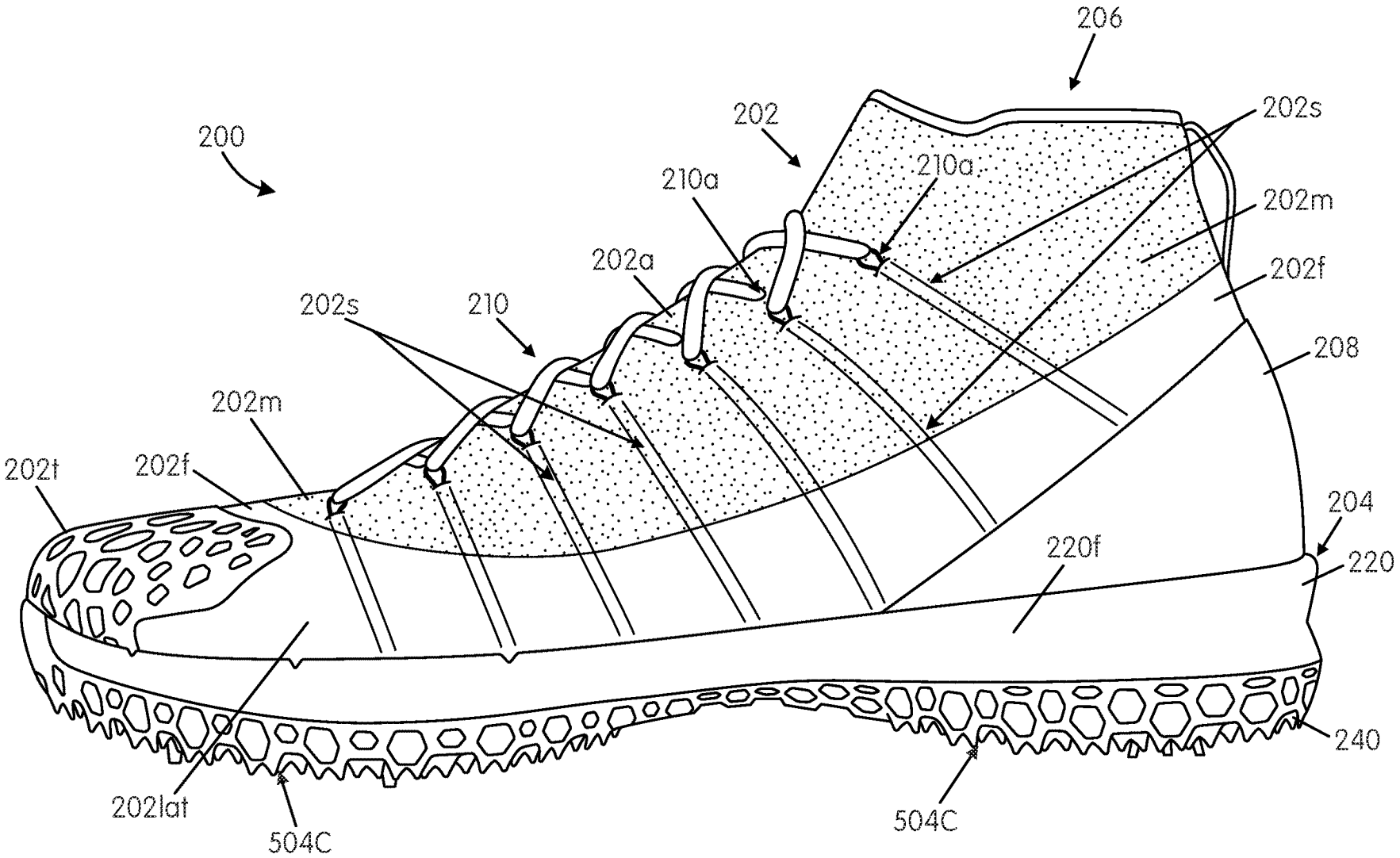
FIGS. 2A-2D provide various views of an example article of footwear according to some aspects of this invention.
Figure 2B:
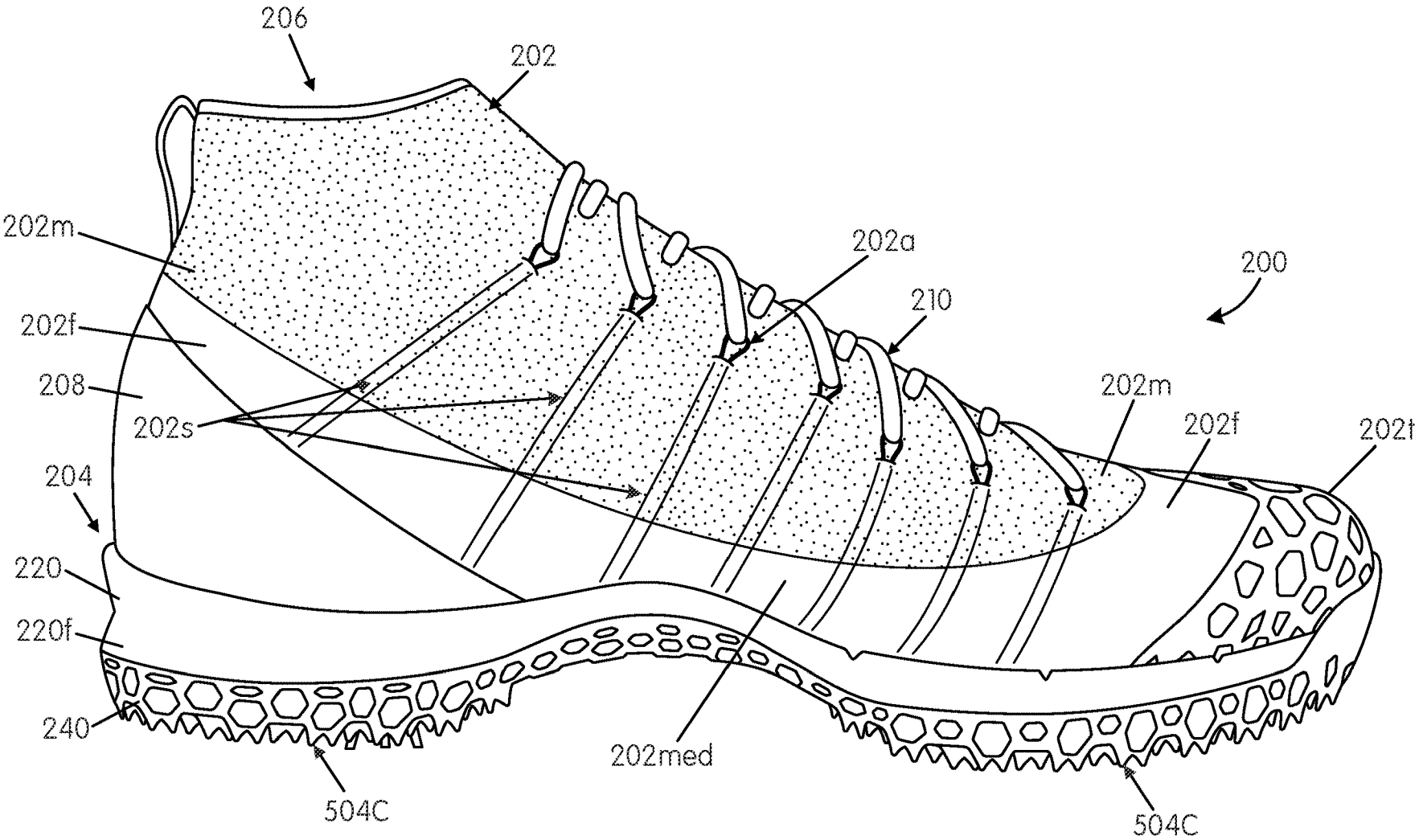
Figure 2C:
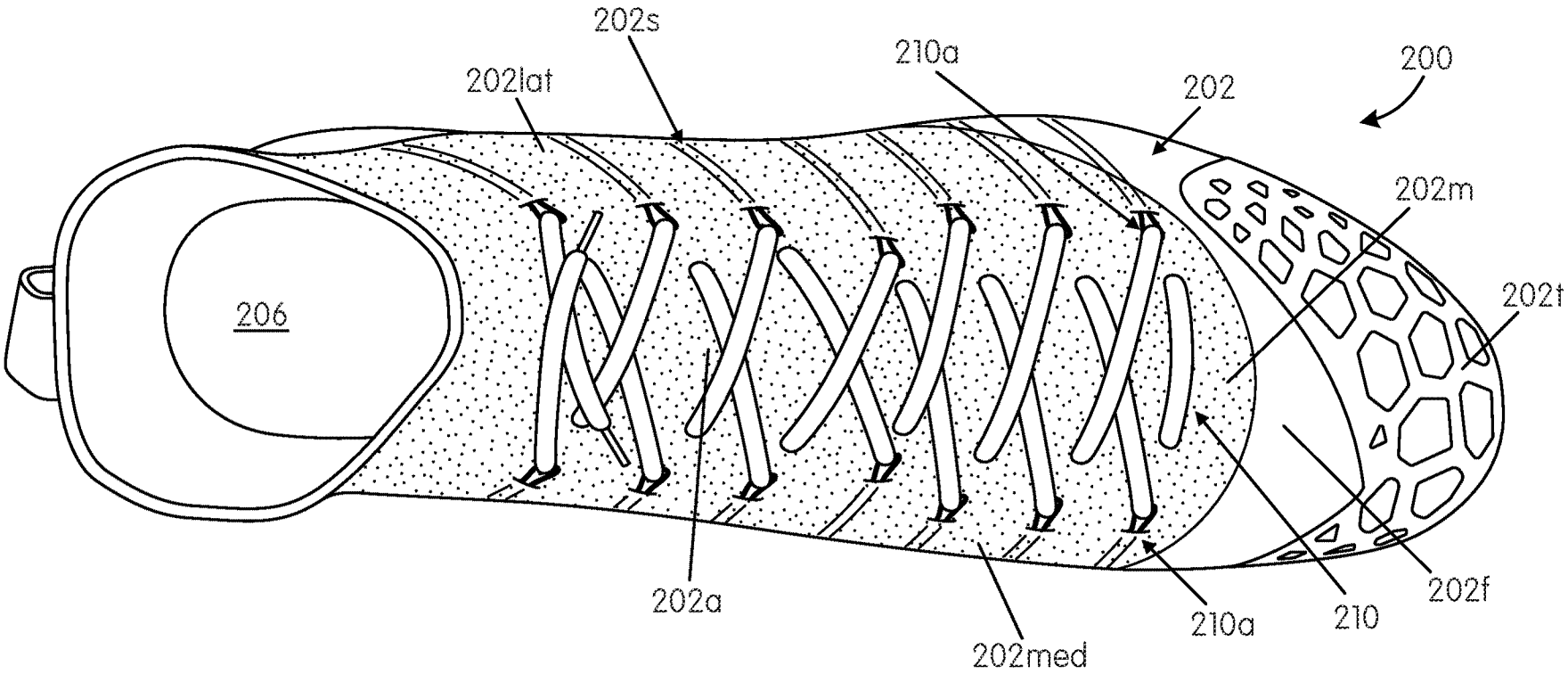
Figure 2D:
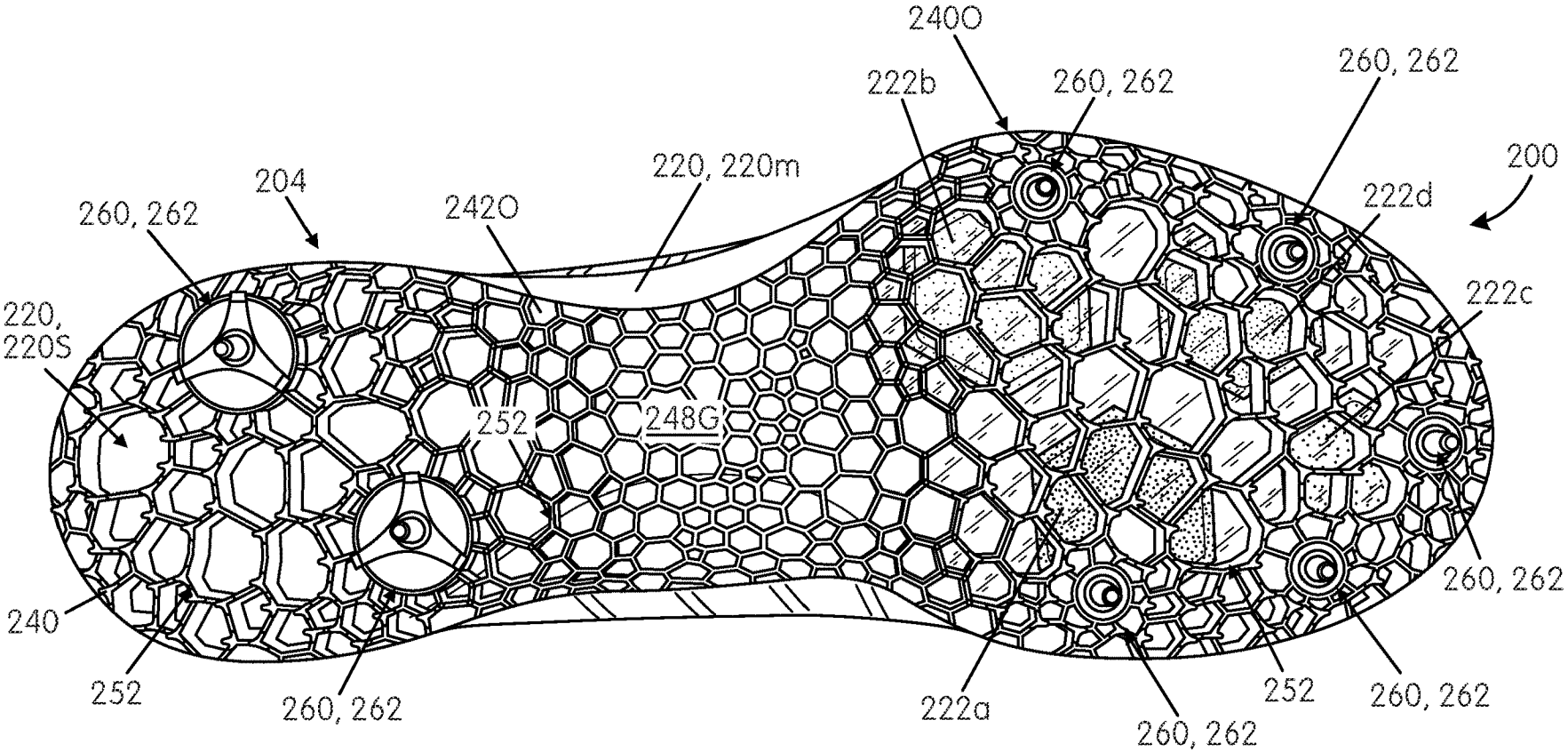

FIGS. 2A-2D provide various views of an article of footwear 200 in accordance with at least some examples of this invention. More specifically, FIG. 2A provides a lateral side view of this example article of footwear 200, FIG. 2B provides a medial side view, FIG. 2C provides a top view, and FIG. 2D provides a bottom view. This example article of footwear 200 is a cleated cricket shoe. Aspects of this invention, however, also may be used in shoes for other types of uses and/or other athletic activities. The article of footwear 200 includes an upper 202 and a sole structure 204 engaged with the upper 202. The upper 202 and sole structure 204 may be engaged together in any desired manner, including in manners conventionally known and used in the footwear arts (such as by adhesives or cements, by stitching or sewing, by mechanical connectors, etc.).

The upper 202 of this example includes a foot-receiving opening 206 that provides access to an interior chamber into which the wearer's foot is inserted. The upper 202 further may include a tongue member located across the foot instep area and positioned so as to moderate the feel of the closure system 210 (which in this illustrated example constitutes a lace type closure system). As shown in the specific example of FIGS. 2A-2C, however, rather than including a separate tongue component, this example upper 202 is formed as a unitary construction with an instep covering component 202*a* integrally formed with and joining the medial side component 202med and the lateral side component 202lat of the upper 202. In this manner, as shown in the figures, the upper 202 has somewhat of sock-like foot-receiving opening 206 and/or a sock-like overall appearance.

The upper 202 may be made from any desired materials and/or in any desired constructions and/or manners without departing from this invention. As some more specific examples, at least a portion of the upper 202 (and optionally a majority, substantially all, or even all of the upper 202) may be formed as a woven textile component and/or as a knitted textile component. The textile components for upper 202 may have structures and/or constructions like those used in FLYKNIT® brand footwear and/or via FLYWEAVE™ technology available in products from NIKE, Inc. of Beaverton, OR.

Additionally or alternatively, if desired, the upper 202 construction may include uppers having foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, uppers and articles of footwear in accordance with this invention may include foot securing and engaging structures of the types used in FLYWIRE® Brand footwear available from NIKE, Inc. of Beaverton, Oregon. These types of wrap-around and/or adaptive or dynamic fit structures are shown as part of the lace engaging elements 210*a* and the components 202*s* shown in example upper 202 of FIGS. 2A-2C. The "components" 202*s* shown in FIGS. 2A-2C may be relatively unstretchable components integrally formed in the upper structure 202, or they may be separate (unstretchable) components engaged with the upper structure 202 and/or laces of the shoe.

As yet another option, if desired, uppers 202 and articles of footwear 200 in accordance with this invention may include fused layers of upper materials, e.g., uppers of the types included in NIKE's "FUSE" line of footwear products. As still additional examples, uppers of the types described in U.S. Pat. Nos. 7,347,011 and/or 8,429,835 may be used without departing from this invention (each of U.S. Pat. Nos. 7,347,011 and 8,429,835 is entirely incorporated herein by reference). FIGS. 2A-2C show fused layers 202*f* of material bonded with an underlying mesh 202*m*, wherein the fused layers 202*f* provide one or more of support (e.g., shape support, foot support), abrasion resistance, wear resistance, durability, desired aesthetics, etc.

FIGS. 2A-2C illustrate additional potential features of a footwear upper 202 in accordance with at least some examples of this invention. More specifically, FIGS. 2A-2C illustrate a matrix type protective toe cap 202*t* that extends from the sole structure 204 at the forward toe area to cover the forward toe area of the upper 202. This toe cap 202*t* provides additional wear resistance and durability to the toe area of the upper 202 while still providing a lightweight and somewhat flexible forward toe area (e.g., provided that the toe cap 202*t* is formed from a sufficiently flexible material). This toe cap 202*t* may be engaged with the upper material (e.g., mesh 202*m* and/or a fuse bonded support layer 202*f*) by a fuse bonding procedure (e.g., using hot melt adhesive), by another adhesive or cement, by mechanical connectors, by the connection between the sole 204 and the upper 202, etc.

The heel area of this example upper 202 includes a heel counter 208, e.g., as shown in FIGS. 2A and 2B. The heel counter 208 provides additional support for the wearer's heel. The heel counter 208 may be a separate component that is engaged with the upper 202, e.g., by an adhesive or cement, by mechanical connectors, by the connection between the sole 204 and the upper 202, etc. Alternatively, the heel counter 208 may be engaged with the sole structure 204 or integrally formed as part of the sole structure 204 (e.g., integrally formed as part of the ground-engaging component, as will be described in more detail below).

The sole structure 204 of this example article of footwear 200 now will be described in more detail. As shown in FIGS. 2A-2D, the sole structure 204 of this example includes two main components: a midsole component 220 and a ground-engaging component 240. While the illustrated midsole component 220 and ground-engaging component 240 each constitute components that extend to support an entire plantar surface of a wearer's foot, if desired, one or both of the midsole component 220 and/or the ground-engaging component 240 may be made from multiple parts and/or may extend to support less than an entire plantar surface of a wearer's foot. The ground-engaging component 240 may be engaged with the side surface(s) and/or the bottom surface 220S of the midsole component 220 via adhesives or cements, mechanical fasteners, sewing or stitching, etc. The midsole component 220 may be located between a bottom surface of the upper 202 (e.g., a strobel member) and the ground-engaging component 240. The midsole component 220 also may be at least partially exposed at the bottom of the sole structure 204, e.g., through openings formed in ground-contacting component 240. These sole structure components will be described in more detail below.

As noted above and with additional reference to FIGS. 4A-4F, one main foot support component of this sole structure 204 is the midsole component 220, which in this illustrated example extends to support an entire plantar surface of the wearer's foot (e.g., from the forward-most toe location FT to the rearmost heel location RH and from the lateral side edge to the medial side edge along the entire longitudinal length of the sole structure 204, as also shown in FIGS. 4A-4D). This midsole component 220, which may be made from one or more parts, may be constructed at least in part from a polymeric foam material member 220*f*, such as a polyurethane foam or an ethylvinylacetate ("EVA") foam as are known and used in the footwear arts. Additionally or alternatively, if desired, at least some portion of the midsole component 220 may include one or more fluid-filled bladders, e.g., of the types conventionally known and used in the footwear arts (e.g., available in NIKE "AIR" Brand products). Four individual fluid-filled bladders 222*a*, 222*b*, 222*c*, and 222*d* are shown in the example structures of FIGS. 2D and 4A-4F, including: (a) a fluid-filled bladder 222*a* at the first metatarsal head support area, (b) a fluid-filled bladder 222*b* at the fourth and/or fifth metatarsal head support area, (c) a fluid-filled bladder 222*c* at the big toe support area, and (d) a fluid-filled bladder 222*d* at the fourth and/or fifth toe support area. Any one or more of these bladders 222*a*-222*d* may be included in a specific midsole component structure 220 and/or other bladders may be provided at other locations. Alternatively, two or more of these bladders 222*a*-222*d* may be combined into a single bladder construction, if desired.

In this illustrated example, a bottom surface 220S of the midsole component 220 is visible and/or exposed at an exterior of the sole structure 204, optionally substantially throughout the bottom of the sole structure 204 (and at least over more than 50% and even more than 75% of the bottom surface area of the sole structure 204). As shown in FIG. 2D, the bottom surface 220S of the midsole component 220 is visible and/or exposed at the forefoot support area, is visible and/or exposed at the arch support area, and/or is visible and/or exposed at the heel support area (e.g., through cells 252 of the matrix structure 250 of the ground-engaging component 240 described in more detail below).

Figure 3A:
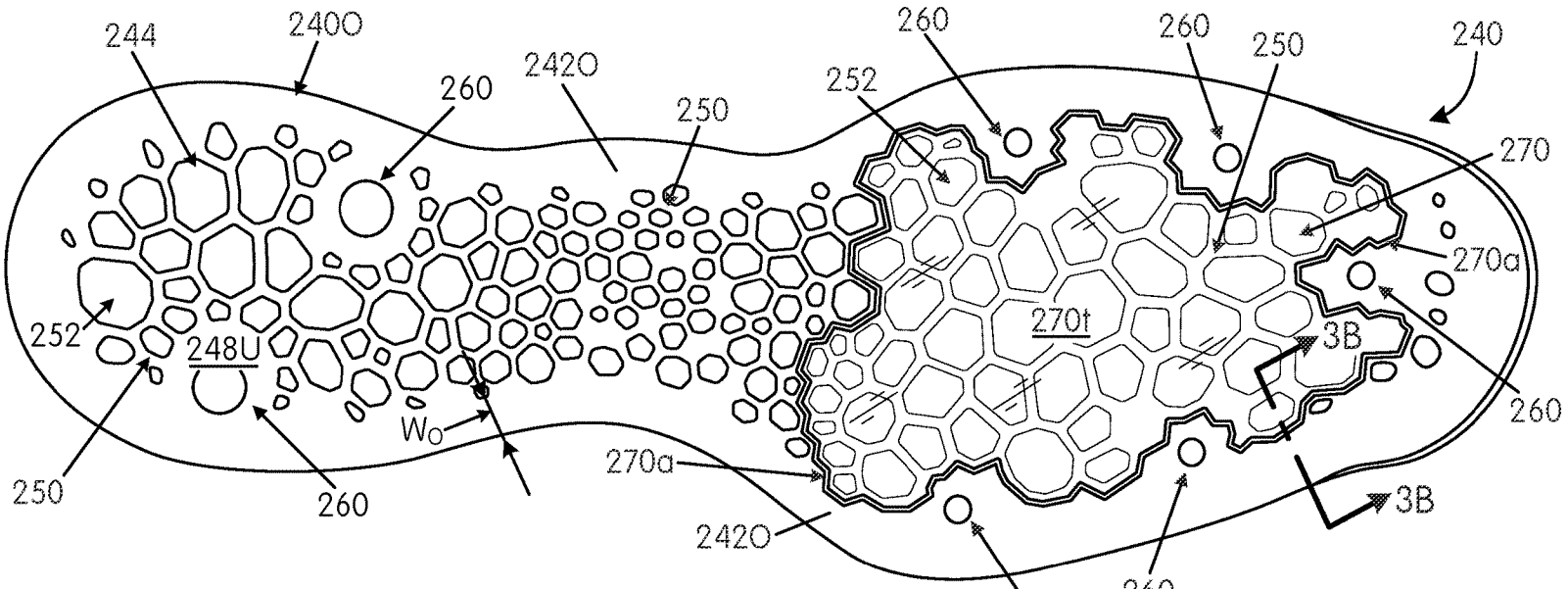
FIGS. 3A-3C provide various views of an example ground-engaging component in accordance with some aspects of this invention.

Example ground-engaging components 240 for sole structures 204/articles of footwear 200 in accordance with some examples of this invention now will be described in more detail with reference to FIGS. 2A through 2D, as well as with reference to FIGS. 3A-3C. As shown, these example ground-engaging components 240 include an outer perimeter boundary rim 2420, for example, that may be at least 3 mm (0.12 inches) wide (and in some examples, is at least 4 mm (0.16 inches) wide, at least 6 mm (0.24 inches) wide, or even at least 8 mm (0.32 inches) wide). This "width" Wo is defined as the direct, shortest distance from one edge (e.g., an exterior edge) of the outer perimeter boundary rim 2420 to its opposite edge (e.g., an interior edge) by the open space 244, as shown in FIG. 3A. While FIG. 3A shows this outer perimeter boundary rim 2420 extending completely and continuously around and defining 100% of an outer perimeter of the ground-engaging component 240, other options are possible. For example, if desired, there may be one or more breaks in the outer perimeter boundary rim 2420 at the outer perimeter of the ground-engaging component 240 such that the outer perimeter boundary rim 2420 is present around only at least 75%, at least 80%, at least 90%, or even at least 95% of the outer perimeter of the ground-engaging component 240. The outer perimeter boundary rim 2420 may have a constant or changing width Wo over the course of the outer perimeter of the ground-engaging component 240.

Figure 3B:
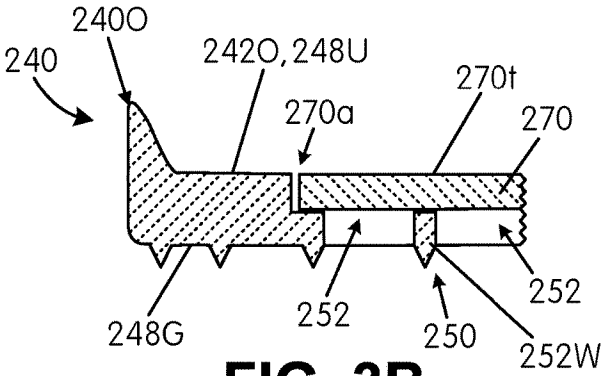
Figure 3C:
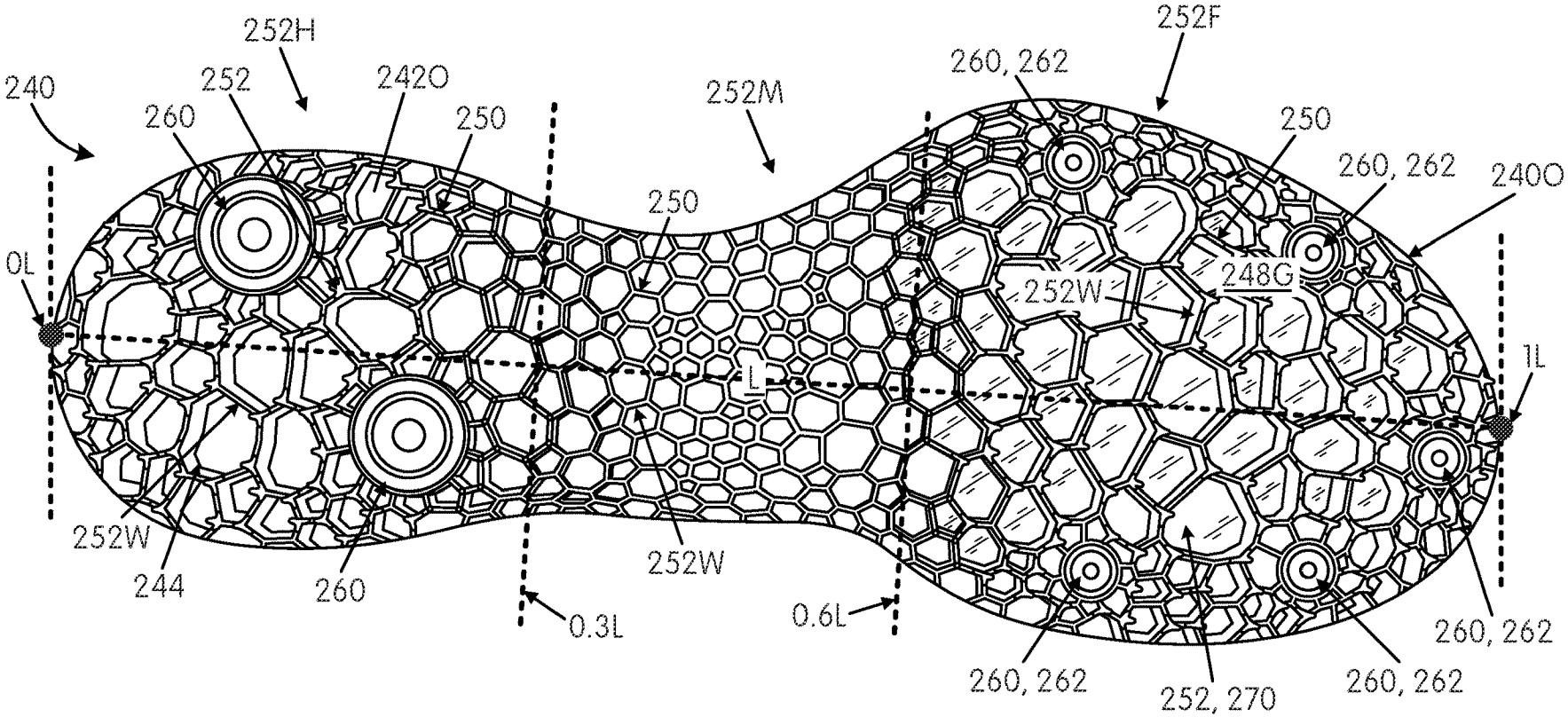

FIGS. 3A and 3C show that the outer perimeter boundary rim 2420 of the ground-engaging component 240 defines an open space 244 of the ground-engaging component 240, and in these illustrated examples, the open space 244 extends at least into the arch support area and the heel support area of the ground-engaging component 240. The upper-facing surface 248U of the ground-engaging component 240 may fit and be fixed into a recess formed in the bottom surface 220S and/or side surface of the midsole component 220 (e.g., a recess molded into the midsole component 220 when it is formed), e.g., by cements or adhesives.

The ground-engaging components 240 of this example is formed and shaped so as to extend completely across the forefoot support area, the arch support area, and the heel support area of the sole structure 204 from the lateral side to the medial side. In this manner, the outer perimeter boundary rim 2420 forms the medial and lateral side edges of the bottom of the sole structure 204 throughout the sole structure 204 (e.g., the ground-engaging component 240 extends to complete support a plantar surface of a wearer's foot).

The outer perimeter boundary rim 2420 of this illustrated example ground-engaging component 240 defines an upper-facing surface 248U (e.g., as shown in FIG. 3A) and a ground-facing surface 248G (e.g., as shown in FIG. 3C) opposite the upper-facing surface 248U. The upper-facing surface 248U provides a surface for supporting the wearer's foot and/or engaging the midsole component 220 (and/or optionally engaging the upper 202, if no midsole is present at some or all locations of the sole structure 204). The outer perimeter boundary rim 2420 may provide a relatively large surface area for securely supporting a plantar surface of a wearer's foot. Further, the outer perimeter boundary rim 2420 may provide a relatively large surface area for securely engaging another footwear component (such as the bottom surface 220S of the midsole component 220 and/or a bottom surface of the upper 202), e.g., a surface for bonding via adhesives or cements, for supporting stitches or sewn seams, for supporting mechanical fasteners, etc.

FIGS. 3A-3C further illustrate that the ground-engaging component 240 of this example sole structure 204 includes a support structure 250 that extends from the outer perimeter boundary rim 2420 into and at least partially across (and optionally completely across) the space 244 defined inside of the boundary rim 2420. The top surface of this example support structure 250, at least at some locations within the space 244, lies flush with and/or smoothly transitions into the outer perimeter boundary rim 2420 to provide a portion of the upper-facing surface 248U (and may be used for the purposes of the upper-facing surface 248U as described above).

The support structure 250 of this example extends from the ground-facing surface 248G of the outer perimeter boundary rim 2420 to define a portion of the ground-facing surface 248G of the ground-engaging component 240. In the illustrated examples of FIGS. 3A-3C, the support structure 250 includes a matrix structure (also labeled 250 herein) extending from the ground-facing surface 248G of the outer perimeter boundary rim 2420 and into, partially across, or fully across the space 244 to define a cellular construction with plural cells 252. The illustrated matrix structure 250 defines at least one of: (a) one or more open cells located within the space 244, (b) one or more partially open cells located within the space 244, and/or (c) one or more closed cells, e.g., beneath the outer perimeter boundary rim 2420, beneath another cover or support member 270, etc. An "open cell" constitutes a cell 252 in which the perimeter of the cell opening is defined completely by the matrix structure 250 and is open (and/or is free of other ground-engaging component 240 parts) at both the top and bottom of the matrix structure 250. A "partially open cell" constitutes a cell 252 in which one or more portions of the perimeter of the cell opening are defined by the matrix structure 250 and one or more other portions of the perimeter of the cell opening are defined by another part of the ground-engaging component 240 structure, such as the outer perimeter boundary rim 2420 and/or another cover or support member 270 (e.g., the outer perimeter boundary rim 2420 or cover or support member 270 covers a portion of at least some part of the opening of a "partially open cell). A "closed cell" may have the outer matrix structure 250, but it is not completely open (e.g., it may be formed such that the portion that would constitute the cell opening is located under the outer perimeter boundary rim 2420 and/or under a cover or support member 270 that forms part of the ground-engaging component).

An "open" cell 252 or a "partially open" cell 252 may leave footwear components located above them exposed through the cell 252. "Closed" cells 252 are closed off by a part of the ground-engaging component 240, and thus do not leave other overlying portions of the footwear structure exposed (although the overlying footwear parts may be visible if the cells 252 are closed by an at least partially transparent or at least partially translucent component). Thus, the "open" and/or "closed" features of a cell 252 are determined based on the components or parts of the ground-engaging component 240 (without reference to other footwear components separate from the ground-engaging component 240). In other words, an "open" cell 252 or a "partially open" cell 252 may be closed off by footwear parts that are not part of the ground-engaging component 240 (e.g., midsole components 220, upper components 202, etc.) and still be considered "open" or "partially open" (because they are open or partially open with respect to the ground-engaging component 240).

As shown in FIGS. 3A-3C, in this illustrated example ground-engaging component 240, a cover or support member 270 is provided at least in a forefoot support area of the ground-engaging member 240 to close off one or more of the cells 252 in the matrix structure 250. This support member 270 may provide additional stiffness and/or support for the foot. As shown in FIGS. 3A and 3C, in this illustrated example, the cover or support member 270 extends to span and/or close multiple cells 252 of the matrix structure 250. In the forefoot region, at least a majority of the cells 252 (and in some examples, at least 60%, at least 70%, at least 80%, at least 90%, or even at least 95% of the cells 252) will be covered or closed off by a cover or support member 270. In FIG. 3A, boundary line 270*a* marks the boundary between cover 270 and the outer perimeter boundary rim 2420 and/or the matrix structure 250 (and as shown in this figure, the extreme forefoot toe area includes some open cells 252 not covered by the cover 270 (e.g., open cells 252 that lie outside of boundary 270*a*)). As shown in FIG. 3B, if desired, the matrix structure 250 may be formed to include a recess (at least) at the forefoot area, and this recess may be sized and shaped to snuggly receive a separate cover 270 such that a top surface 270*t* of the cover 270 lies flush with and/or smoothly transitions into the upper surface 248U of the remainder of the ground-engaging component 240. In this manner, as illustrated in FIG. 3B, the bottoms of one or more of the closed forefoot support cells 252 may be open and the cover 270 closes a top of those one or more closed forefoot support cells 252.

Rather than a separate part, the cover or support member 270 may be integrally formed with and extend from a top surface of the matrix structure 250, e.g., as a unitary, one piece construction. As another alternative or option, the cover 270 may be formed with the remainder of the ground-engaging component 240 in a two-step (dual shot) molding process, e.g., in which a material of the matrix structure 250 is first injected into a mold, a plate is removed from the mold (to provide the recess described above), and a material of the cover or support member 270 is then injected into the mold to fill the recess. Alternatively, the dual shot molding process could inject the materials in a different order (e.g., with the cover 270 material injected first into the mold, followed by the material for the matrix structure 250 and/or outer perimeter boundary rim 2420). As yet another example, if desired, the matrix structure 250 and cover or support plate 270 can be separately formed and then joined together (optionally fixed together using a cement or adhesive, a mechanical fastener, a friction fit, engaging or interlocking parts, etc.).

If desired, the cover 270 may be at least partially made from a material that is transparent, translucent, at least partially transparent, or at least partially translucent. In this manner, as shown in FIG. 2D (and FIG. 5A), features of the midsole component 220 (e.g., bladders 222*a*-222*f*) may be visible through the cells 252 of the matrix structure 250 and through the cover 270. The cover 270 may be made from a flexible plastic material, such as a thermoplastic polyurethane, a poly-ether-block co-polyamide polymer (e.g., of the types available from Atofina Corporation of Puteaux, France under the trademark PEBAX®), etc.

As further shown in FIGS. 2D, 3A, and 3C, the matrix structure 250 may further define one or more primary traction element or cleat support areas 260. Seven separate cleat support areas 260 are shown in the examples of FIGS. 2D, 3A, and 3C, with: (a) three primary cleat support areas 260 on the lateral side of the ground-engaging component 240 (one at or near a lateral or midfoot forefoot support area of the ground-engaging component 240 (e.g., at or near a fifth metatarsal head support area), one forward of that one in the lateral forefoot support area (e.g., at or near a fourth and/or fifth toe support area), and one at the rear, lateral heel support area) and (b) four primary cleat support areas 260 on the medial side of the ground-engaging component 240 (one at or near a first metatarsal head support area, one forward of that one in the medial forefoot support area, one forward of that one at the forward toe support area, and one at the medial heel support area). Primary traction elements, such as spikes 262 or other cleats, may be engaged with the ground-engaging component 240 at the cleat support areas 260 (e.g., with one primary cleat or spike 262 mounted per cleat support area 260). The cleats or spikes 262 (also called "primary traction elements" herein) may be permanently fixed at their associated cleat support areas 260, such as by molding or in-molding the cleats or spikes 262 into the cleat support areas 260 when the matrix structure 250 is formed (e.g., by molding). In such structures, the cleat or spike 262 may include a disk or outer perimeter member that is embedded in the material of the cleat support area 260 during the molding process. As another alternative, the cleats or spikes 262 may be removably mounted to the ground-engaging component 240, e.g., by a threaded type connector, a turnbuckle type connector, or other removable cleat/spike structures as are known and used in the footwear arts. Hardware or other structures 262B for mounting the removable cleats may be integrally formed in the mount area 260 or otherwise engaged in the mount area (e.g., by in-molding, adhesives, or mechanical connectors).

The cleat support areas 260 can take on various structures without departing from this invention. In the illustrated example, the cleat support areas 260 are defined by and as part of the matrix structure 250 as a thicker portion of matrix material located within or partially within the outer perimeter boundary rim 2420 and/or located within the space 244. Small sized closed cells 252 may be provided immediately around the cleat mount areas 260, e.g., to increase strength and/or stiffness at the cleat mount areas 260. As various options, if desired, one or more of the cleat support areas 260 may be defined in one or more of the following areas: (a) solely in the outer perimeter boundary rim 2420, (b) partially in the outer perimeter boundary rim 2420 and partially in the space 244, (c) completely within the space 244 (and optionally located at or adjacent the outer perimeter boundary rim 2420), and/or outside of the area covered by cover 270. When multiple cleat support areas 260 are present in a single ground-engaging component 240, all of the cleat support areas 260 need not have the same size, construction, and/or orientation with respect to the outer perimeter boundary rim 2420, with respect to space 244, and/or with respect to one another (although they all may have the same size, construction, and/or orientation, if desired).

Figure 7:
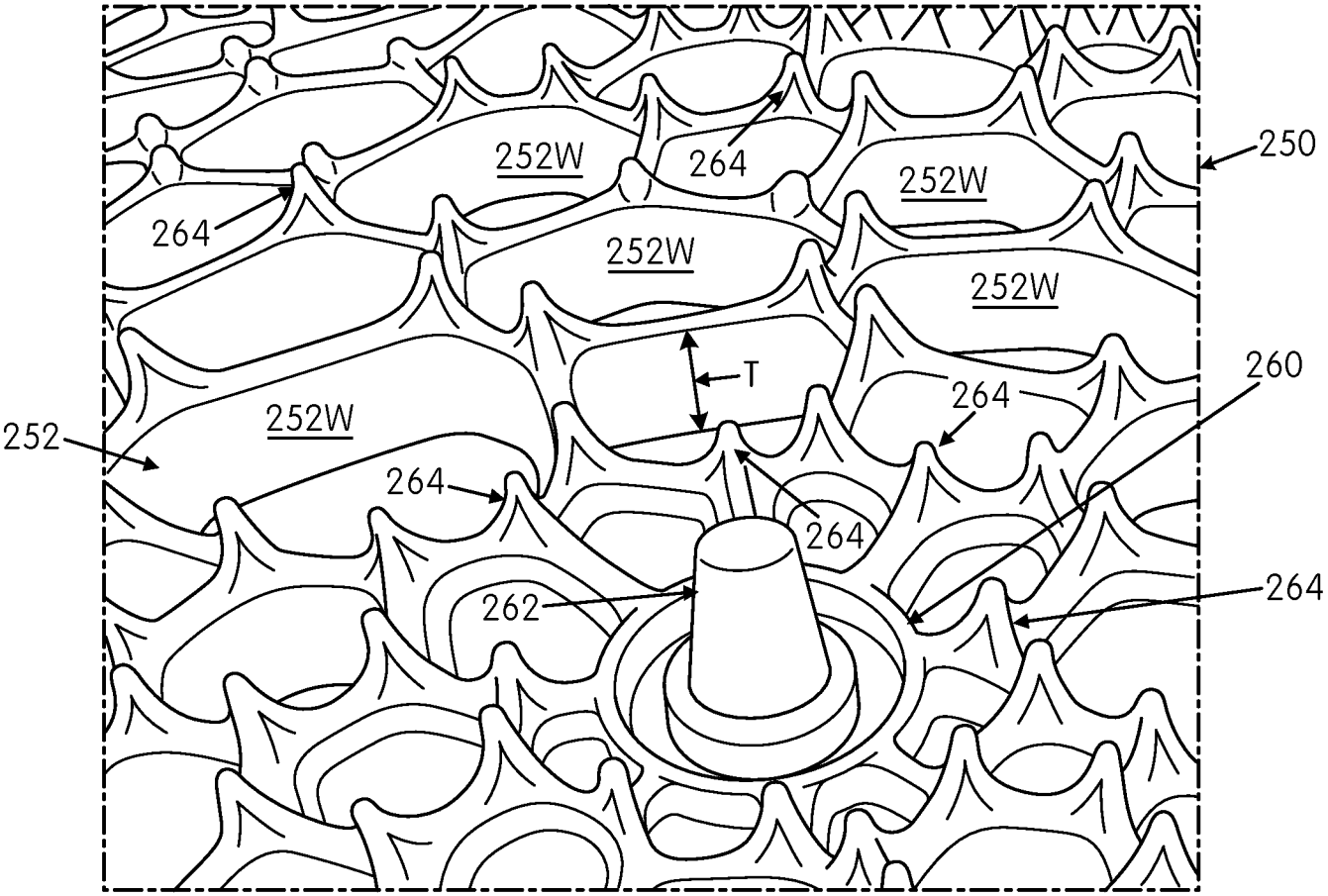
FIG. 7 is a close up view of a portion of a matrix structure to show some example features that may be included in ground-engaging components in accordance with at least some examples of this invention.

While other constructions are possible, in this illustrated example, the cleat support areas 260 are integrally formed as part of the matrix structure 250 and/or outer perimeter boundary rim 2420 structure. The illustrated example further shows that, at least at the forefoot area, the matrix structure 250 defines a plurality of secondary traction elements 264 dispersed around the cleat support areas 260. Note also FIG. 7, which shows a close up view around one cleat support area 260 and primary cleat 262. Any desired number of secondary traction elements 264 may be provided immediately around an individual primary cleat 262, such as from three to 16 secondary traction elements 264, and in some examples, from 4-12 secondary traction elements 264, from 5-10 secondary traction elements 264, or even from 6-10 secondary traction elements 264. The secondary traction elements 264 of this example are raised, sharp points or pyramid type structures made of the matrix 250 material that extend outward from a base surface of the cleat support area 260. The free ends or tips of the primary traction elements 262 extend beyond the free ends or points of the secondary traction elements 264 (in the cleat extension direction and/or when the shoe 200 is positioned on a flat surface) and are designed to engage the ground first. If the primary traction elements 262 sink a sufficient depth into the contact surface (e.g., a track, the ground, etc.), the secondary traction elements 264 then may engage the contact surface and provide additional traction to the wearer.

In at least some examples of this invention, the outer perimeter boundary rim 2420 and the support structure 250 extending into/across the space 244 may constitute a unitary, one-piece construction. The one-piece construction can be formed from a polymeric material, such as a thermoplastic polyurethane, a poly-ether-block co-polyamide polymer (e.g., of the types available from Atofina Corporation of Puteaux, France under the trademark PEBAX®), a thermosetting polyurethane, a fiber reinforced plastic material (e.g., a carbon fiber material, a glass fiber reinforced material, etc.), etc. As another example, if desired, the ground-engaging component 240 may be made as multiple parts (e.g., split at the forward-most toe area, split along the front-to-back direction, and/or split or separated at other areas), wherein each part includes one or more of: at least a portion of the outer perimeter boundary rim 2420 and at least a portion of the support structure 250. As another option, if desired, rather than a unitary, one-piece construction, one or more of the outer perimeter boundary rim 2420 and the support structure 250 individually may be made of two or more parts.

Accordingly, as illustrated in FIGS. 2A-3C, ground-engaging components 240 for articles of footwear 200 in accordance with at least some examples of this invention will include: (a) an upper-facing surface 248U and (b) a ground-facing surface 248G opposite the upper-facing surface 248U, wherein at least the ground-facing surface 248G includes a matrix structure 250, and wherein the matrix structure 250 includes: (a) a heel region 252H including a plurality of open heel support cells 252, (b) a midfoot region 252M including a plurality of open midfoot support cells 252, and (c) a forefoot region 252F including a plurality of closed forefoot support cells 252. For purposes of this application, as shown in FIG. 3C, the "heel region" will be interpreted as extending between planes perpendicular to the longitudinal direction L located at 0L and 0.3L; the "midfoot region" (or "arch region") will be interpreted as extending between planes perpendicular to the longitudinal direction L located at 0.3L and 0.6L; and the "forefoot region" will be interpreted as extending between planes perpendicular to the longitudinal direction L located at 0.6L and 1.0 L.

Various features of the ground-engaging component 240 and/or its matrix structure 250 can be selected so as to provide desired levels of support, stiffness, flexibility, etc., at various local areas of the sole structure 204. In this manner, local areas of the ground-engaging component 240 can be tailored to provide the desired response for its intended use (e.g., for use in playing cricket, in this illustrated example). For example, the cell 252 sizes or areas, the cell wall 252W heights (T, see FIG. 7), cell wall thicknesses or widths, and the like, can be tailored, selected, and changed over the overall area of the component 240 so as to provide desired levels of stiffness and/or flexibility at all local areas. Desired levels of stiffness and/or flexibility over various local areas of the ground-engaging components 240 can be determined, at least in part, e.g., by considering two dimensional foot force and/or foot pressure maps and/or by taking foot force or foot pressure measurements when an athlete is engaged in cricket (or other) activities (or simulations of cricket (or other) activities). The matrix structure 250 helps provide a lightweight construction that can be tailored by altering cell dimensions and/or features to provide the desired local properties and response characteristics.

As some more specific examples, in at least some ground-engaging components 240 according to the invention, an average area enclosed by side walls 252W of the plurality of open heel support cells 252 (cells 252 fully contained in the heel region 252H) will be greater than an average area enclosed by side walls 252W of the plurality of open midfoot support cells 252 (cells 252 fully contained in the midfoot region 252M), and/or an average area enclosed by side walls 252W of the plurality of closed forefoot support cells 252 (cells 252 fully contained in the forefoot region 252F) is greater than the average area enclosed by the side walls 252W of the plurality of open midfoot support cells 252 (cells 252 fully contained in the midfoot region 252M). In other words, as shown in the examples of FIGS. 2D, 3A, 3C (and others), on average, the cells 252 in the heel region 252H and/or the forefoot region 252F are larger than the cells 252 in the midfoot region 252M. These averages are determined for cells 252 located only completely within a given region (e.g., if a cell 252 bridges one of the noted perpendicular planes, its area is not counted toward either average area). In some examples, the average area of the open heel region cells 252 and/or the average area of the closed forefoot region cells 252 will be at least 1.5 times (or even at least 2 times or 2.5 times) the average area of the open midfoot region cells 252.

As another potential property for ground-engaging components 240 in accordance with at least some examples of this invention, (a) the heel region 252H will include a heel region support cell size differential ($\Delta A_H$), wherein:

$$\Delta A_H = A_{HL} - A_{HS},$$

wherein $A_{HL}$ is an area enclosed by side walls 252W of a largest open heel support cell 252 located fully in the heel region 252H and $A_{HS}$ is an area enclosed by side walls 252W of a smallest open heel support cell 252 located fully in the heel region 252H, (b) the midfoot region 252M will include a midfoot region support cell size differential ($\Delta A_M$), wherein:

$$\Delta A_M = A_{ML} - A_{MS},$$

wherein $A_{ML}$ is an area enclosed by side walls 252W of a largest open midfoot support cell 252 located fully in the midfoot region 252M and $A_{MS}$ is an area enclosed by side walls 252W of a smallest open midfoot heel support cell 252 located fully in the midfoot region 252M, and (c) the forefoot region 252F includes a forefoot region support cell size differential ($\Delta A_F$), wherein:

$$\Delta A_F = A_{FL} - A_{FS},$$

wherein $A_{FL}$ is an area enclosed by side walls 252W of a largest closed forefoot support cell 252 located fully in the forefoot region 252F and $A_{FS}$ is an area enclosed by side walls 252W of a smallest closed forefoot heel support cell 252 located fully in the forefoot region 252W. In at least some examples of this invention:

$$\Delta A_H \geq 2 \times \Delta A_M \text{ and/or } \Delta A_F \geq 2 \times \Delta A_M, \text{ and optionally}$$

$$\Delta A_H \geq 4 \times \Delta A_M \text{ and/or } \Delta A_F \geq 4 \times \Delta A_M, \text{ or even}$$

$$\Delta A_H \geq 6 \times \Delta A_M \text{ and/or } \Delta A_F \geq 6 \times \Delta A_M$$

These formulae define that the open cell 252 areas and/or open cell size range in the midfoot region 252M are smaller than open cell 252 areas and/or open cell size range in the heel region 252H and/or the closed cell 252 areas and/or closed cell size range in the forefoot region 252F. If more than one cell 252 in a given region 252H, 252M, and/or 252H have the same largest area or smallest area, any one of these corresponding same sized cells may be used in the formulae above.

As other potential properties, in at least some ground-engaging components 240 according to the invention: (a) the heel region 252H includes a tallest sidewall height $T_H$ of sidewalls 252W in the plurality of open heel support cells 252 located fully in the heel region 252H, (b) the midfoot region 252M includes a tallest sidewall height $T_M$ of sidewalls 252W in the plurality of open midfoot support cells 252 located fully in the midfoot region 252M, and (c) the forefoot region 252F includes a tallest sidewall height $T_F$ of sidewalls 252W in the plurality of closed forefoot support cells 252 located fully in the forefoot region 252F. These height dimensions T are measured in the direction extending directly from the upper-facing surface 248U to the ground-facing surface 248G through a cell 252 (e.g., note FIG. 7). In at least some examples of this invention:

$$T_H \geq 2 \times T_M \text{ and/or } T_F \geq 2 \times T_M, \text{ and optionally,}$$

$$T_H \geq 4 \times T_M \text{ and/or } T_F \geq 4 \times T_M.$$

These formulae define that the tallest cell wall 252W in the midfoot region 252M is shorter than the tallest cell wall 252W in the heel region 252H and/or the tallest cell wall in the forefoot region 252F. If more than one cell wall 252 in a given region 252H, 252M, and/or 252H have the same tallest height dimension, any one of these corresponding same tallest height dimensions may be used in the formulae above.

As noted above, FIGS. 2D-3C illustrate that the ground-engaging component 240 includes perimeter rim 2420 extending around its outer perimeter. In some examples of this invention, a perimeter edge will be defined as including an area from an outer perimeter 2400 to a distance located inward 0.5 inches from the outer perimeter 2400 of the ground-engaging component 240. If desired, in accordance with at least some examples of this invention, an average area of the plurality of closed forefoot support cells 252 that make up (and are located fully within the perimeter edge (i.e., the area 0.5 inch inward from the outer perimeter 2400) will be at least 10% smaller (and in some examples, at least 20% smaller or even at least 30% smaller) than an average area of the plurality of closed forefoot support cells 252 not making up that perimeter edge (i.e., the closed cells 252 located completely inside of the perimeter edge).

As mentioned above, the sole structure 204 of this illustrated example includes a midsole component 220, which will be described in more detail below. The midsole component 220 may take on any desired structure or construction without departing from this invention, including conventional midsole structures and constructions as are known and used in the footwear art.

Figure 4A:
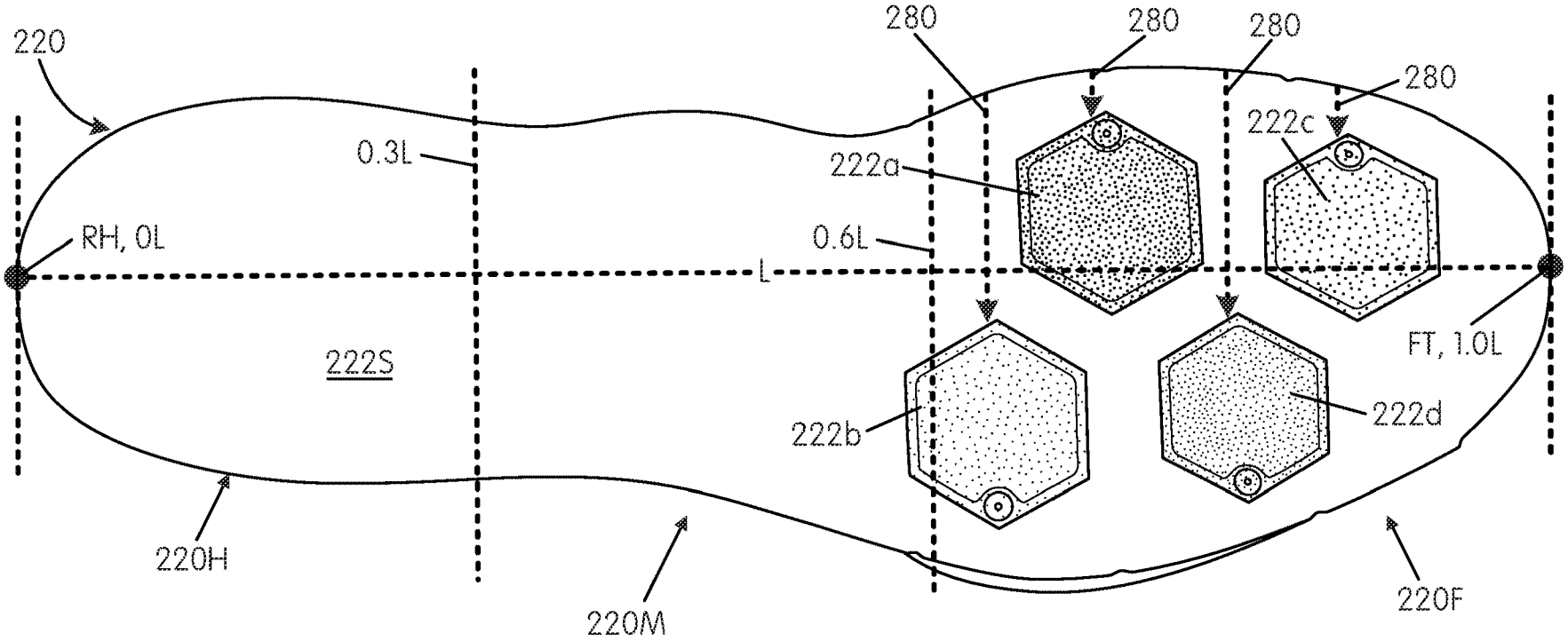
FIGS. 4A-4F provide various views of an example midsole component included in sole structures in accordance with some aspects of this invention.

FIGS. 4A-4F, however, illustrate more detailed features of one example midsole component 220 that may be used in footwear structures 200 and/or sole structures 204 in accordance with at least some examples of this invention. More specifically, this example midsole component 220 includes at least one of a foam midsole element and at least one fluid-filled bladder. Even more specifically, this example midsole component 220 includes a single foam midsole element 222F with which four fluid-filled bladders 222*a*-222*d* are engaged. At least some, and optionally a majority or even all of the plantar support surface area 222S that includes fluid-filled bladder 222*a*-222*d* support may be provided in the forefoot region of the midsole component 220. As shown in FIG. 4A, the "heel region" 220H of the midsole component 220 is defined herein as being between perpendicular planes located at 0L and 0.3L of the midsole component 220, the "midfoot region" 220M of the midsole component 220 is defined herein as being between perpendicular planes located at 0.3L and 0.6L, and the "forefoot region" 220F is defined herein as being between perpendicular planes located at 0.6L and 1.0L.

Figure 4B:
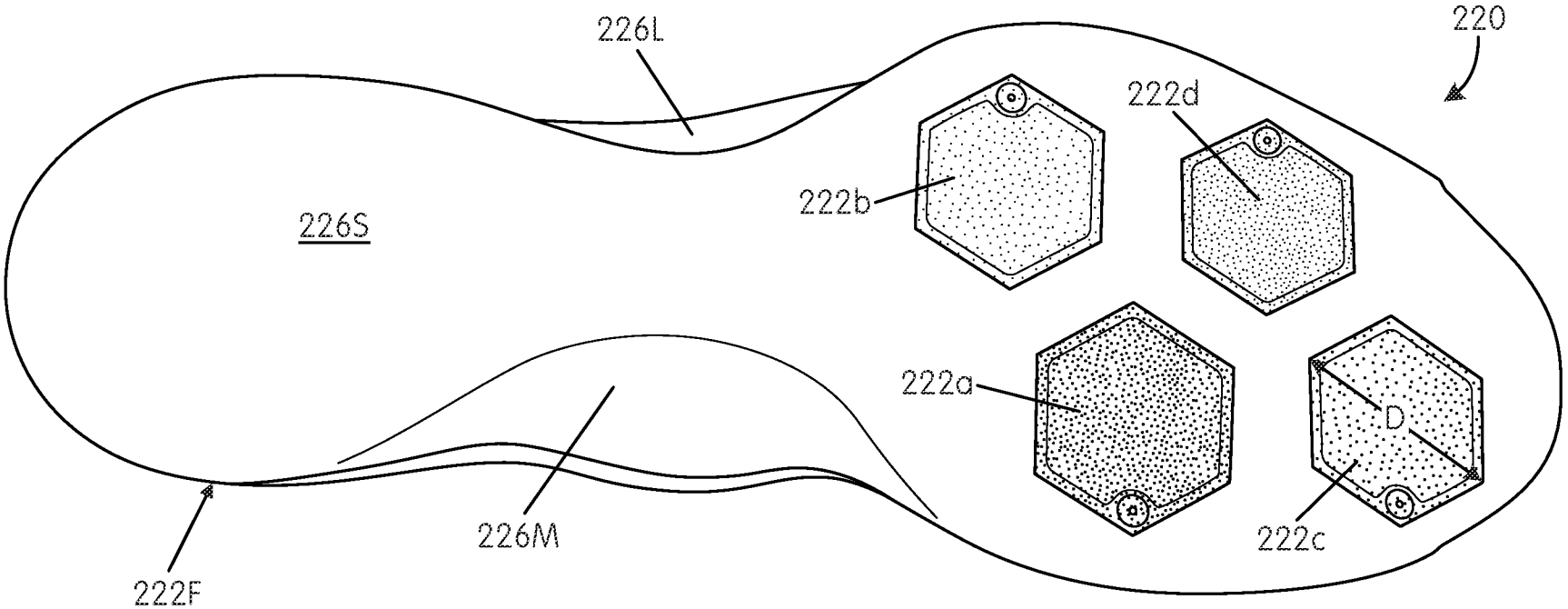

In this specifically illustrated example, the midsole component 220 includes: (a) one fluid-filled bladder 222*a* located at a first metatarsal head support area of the sole structure 204 and/or the midsole component 220; (b) one fluid-filled bladder 222*b* located at a fourth and/or fifth metatarsal head support area of the sole structure 204 and/or the midsole component 220; (c) one fluid-filled bladder 222*c* located forward of bladder 222*a* (e.g., in a "big toe" support area to provide support during the toe-off phase of a step cycle); and (d) one fluid-filled bladder 222*d* located forward of bladder 222*d* (e.g., in the fourth and/or fifth toe support area). As shown in FIGS. 4A and 4B, bladders 222*a* and/or 222*c* are located closer to a medial side edge of foam midsole element 222F and/or midsole component 220 than are bladders 222*b* and/or 222*d*. Bladders 222*b* and/or 222*d* are located closer to a lateral side edge of foam midsole element 222F and/or midsole component 220 than are bladders 222*a* and/or 222*c*. The "distance" that a bladder is located from a side edge is measured as the shortest distance in the transverse direction from the relevant edge to the bladder, e.g., the distances from the medial side edge are shown by arrows 280 in FIG. 4A.

Figure 4C:
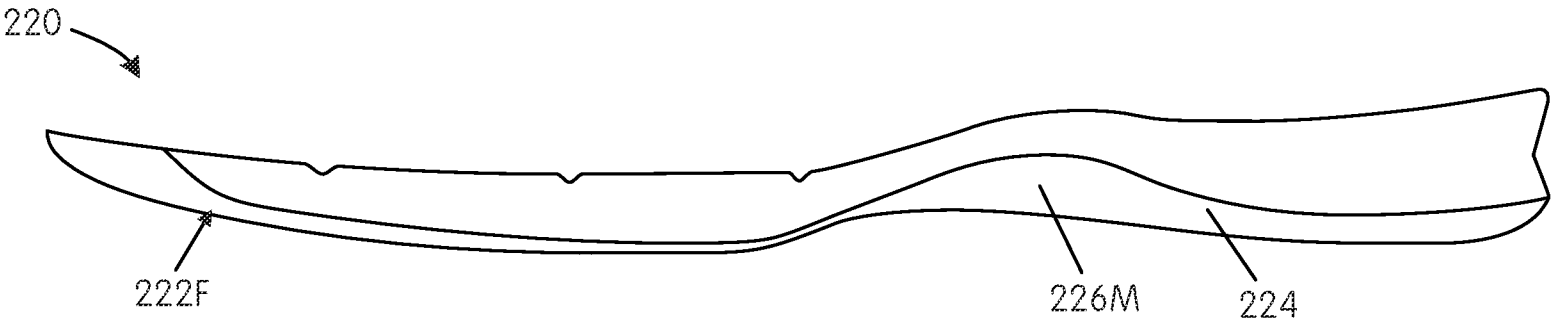
Figure 4D:
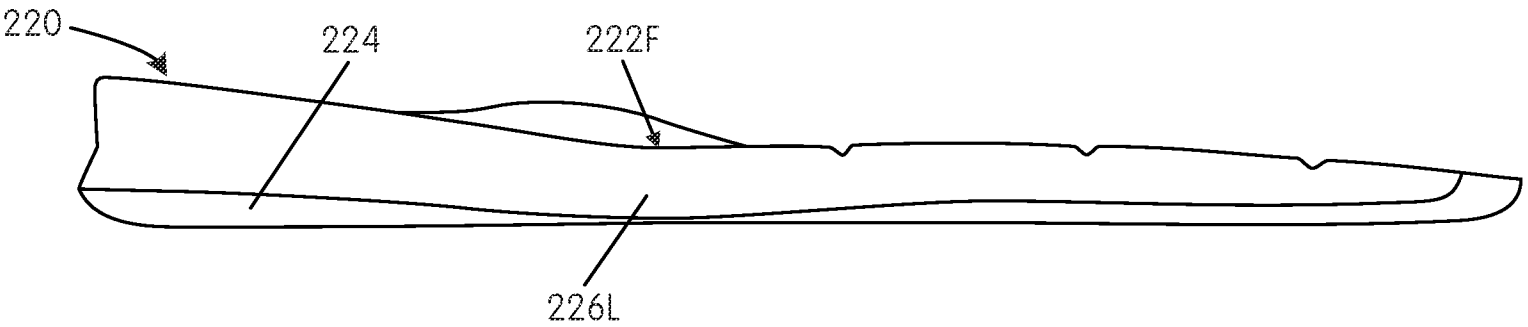
Figure 5A:
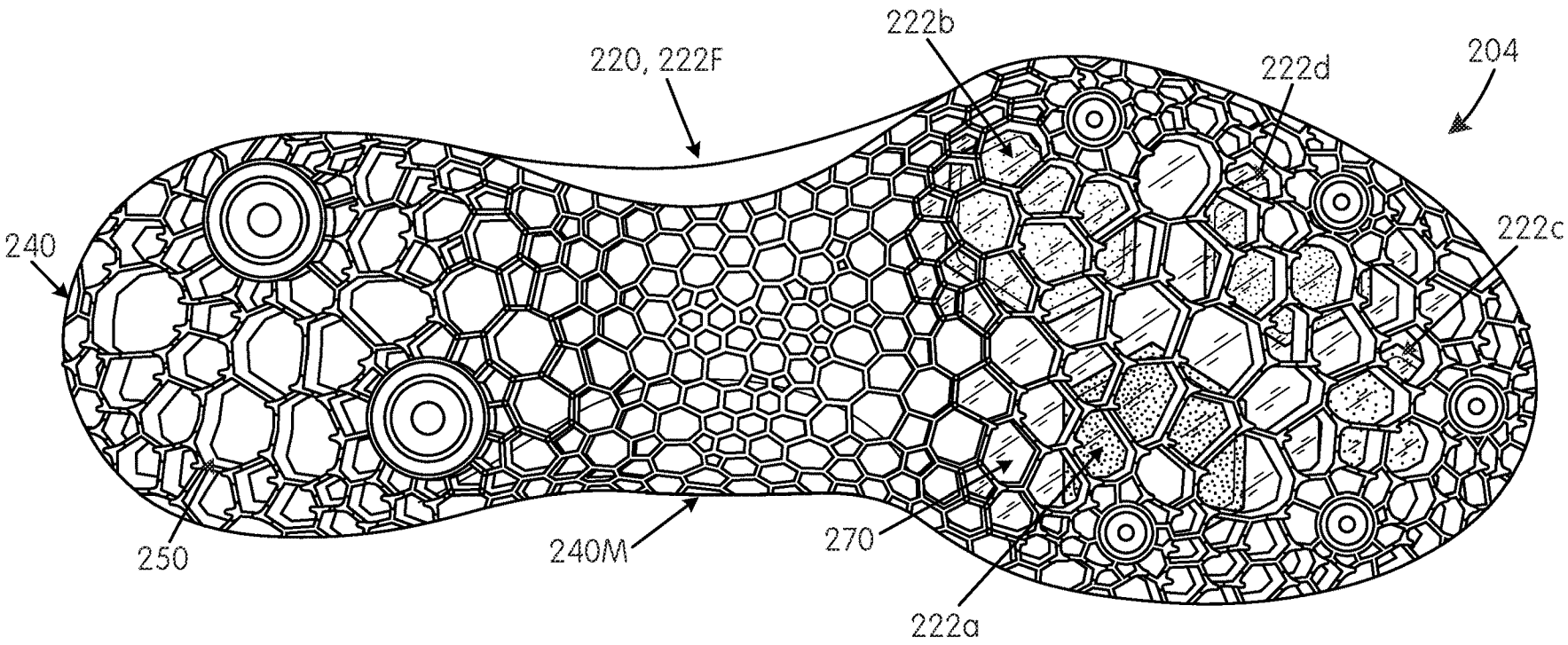
FIGS. 5A-5C provide various views of a sole structure in accordance with some examples of this invention including the ground-engaging component of FIGS. 3A-3C combined with the midsole component of FIGS. 4A-4F.
Figure 5B:
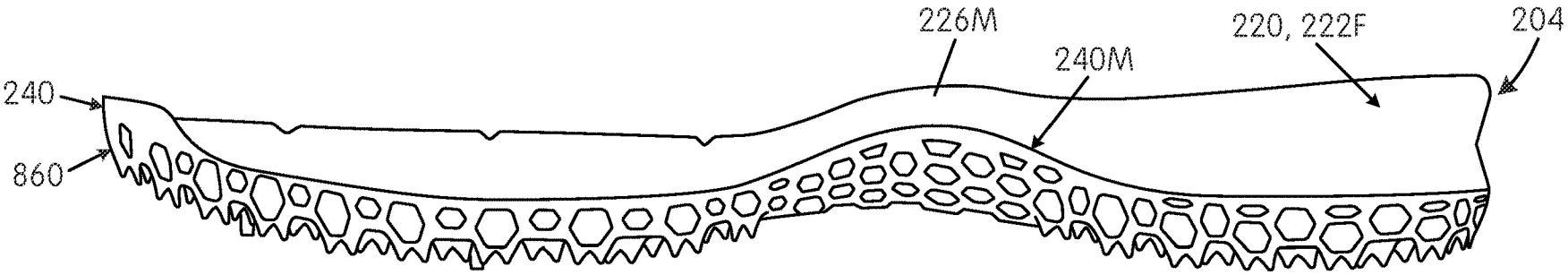
Figure 5C:
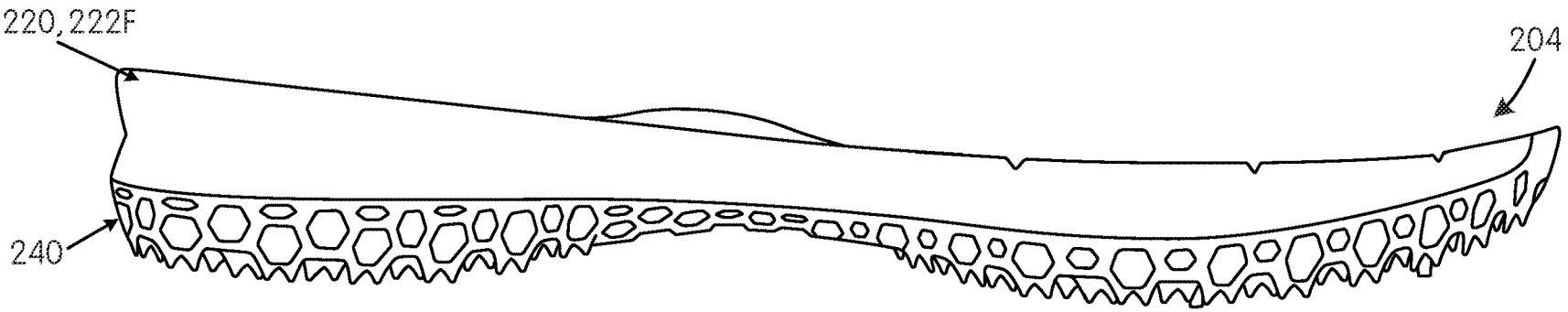

FIGS. 4C-4D further illustrate that the foam midsole element 222F may be formed to include a recess 224 or recesses on its exterior surface(s) onto which the ground-engaging component 240 will be mounted (e.g., as shown in FIGS. 5A-5C). The recess(es) 224 may be molded directly into the surface(s) of the foam midsole element 222F. The recess(es) 224 can help correctly position and/or hold the parts during their assembly. FIGS. 4B-4D further illustrate that the side arch areas 226M and 226L of the foam midsole element 222F extend somewhat upward from the bottom surface 226S of the foam midsole element 222F. These upward extending side arch areas 226M and 226L provide additional support for the arch, particularly when combined with the complementary structure of the relatively stiff and/or hard ground-engaging component 240, as will be described in more detail below in conjunction with FIGS. 5A-5C.

Figure 4E:
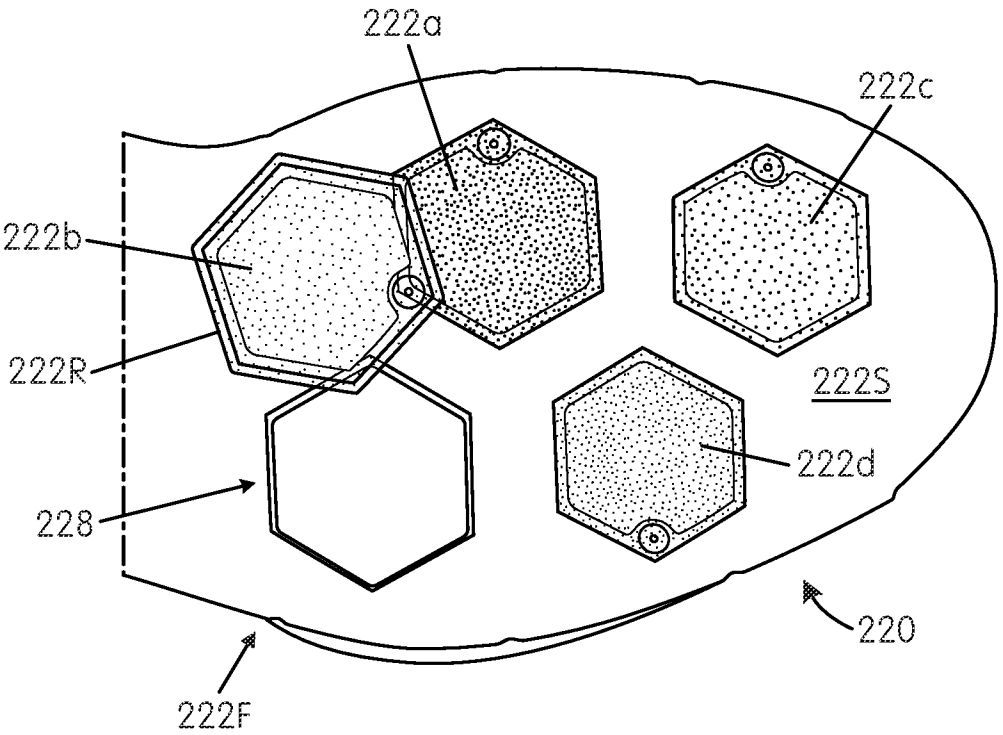
Figure 4F:
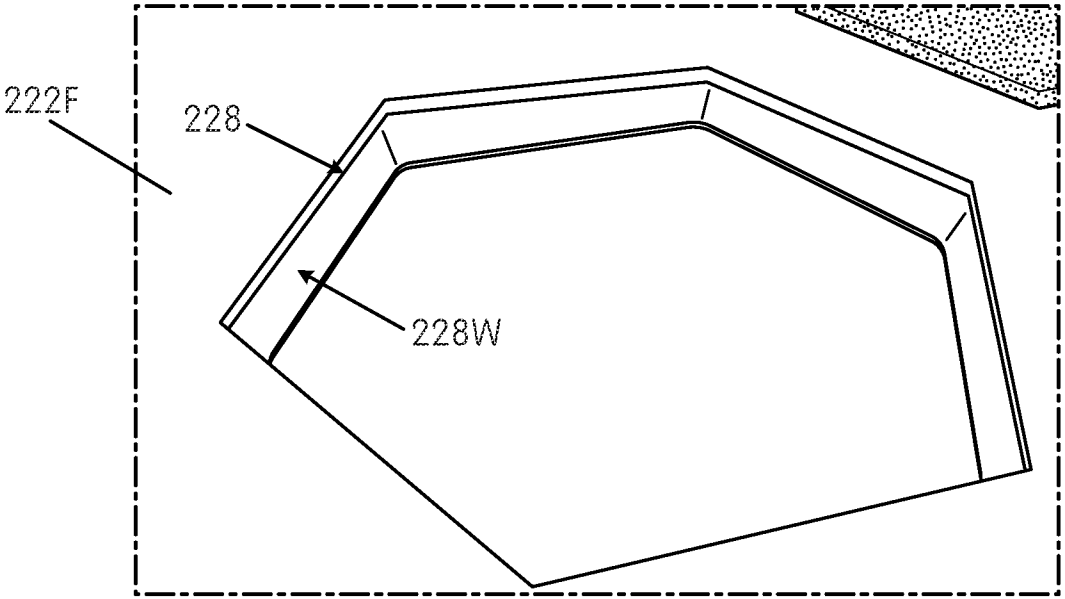

In this illustrated example midsole structure 220, as evident from FIGS. 4E and 4F, the midsole foam element 222F is formed to include openings 228 in which the fluid-filled bladders 222*a*-222*d* are housed and engaged with the midsole foam element 222F. In this manner, surfaces of the fluid-filled bladders 222*a*-222*d* are visible and exposed at both the top and bottom surfaces of the midsole foam element 222F, as shown in FIGS. 4A and 4B. The fluid-filled bladders 222*a*-222*d* are responsive and provide excellent energy return to the wearer's foot upon compression (e.g., the bladders 222*a*-222*d* return quickly to their original configuration and provide return energy to the foot after compression and the compressive force is relaxed). While the example midsole component structure 220 of FIGS. 4A-4F shows relatively thin (e.g., less than ½ inch thick, and even less than ¼ inch thick), relatively large (e.g., 1.25 to 2.25 inch diagonal dimensions D (from one vertex to its opposite vertex)), and relatively flat, hexagonal fluid-filled bladders 222*a*-222*d*, any size, shape, configuration, and/or number of fluid-filled bladders may be used without departing from this invention. Also, while FIGS. 4A-4F show a midsole configuration 220 with four substantially identically sized fluid-filled bladders 222*a*-222*f*, if desired, a single midsole component 220 may have multiple fluid-filled bladders of two or more different sizes without departing from this invention.

The fluid-filled bladder(s), e.g., 222*a*-222*d*, when present, may be engaged with the foam midsole component 222F (if any) in any desired manner without departing from this invention. As shown in FIGS. 4E and 4F, in this illustrated example, the openings 228 into which the bladders 222*a*-222*d* are inserted include a side wall 228W extending through the thickness of the foam midsole element 222F. This side wall 228W may be formed to have an inwardly extending, concave surface, and a perimeter rim 222R of a fluid-filled bladder element 222*a*-222*d* can extend and fit into this side wall 228W. In this manner, if desired, the bladders 222*a*-222*d* can be engaged with the midsole foam element 222F using a friction fit (and the use of adhesives or cements can be avoided for engaging the bladders 222*a*-222*d* with the midsole foam element 222F). Alternatively, if desired, adhesives or cements, mechanical connectors, or fusing techniques (e.g., hot melts) may be used to engage the bladders 222*a*-222*d* with the midsole foam element 222F.

While fitting the bladders 222*a*-222*d* into openings 228 defined completely through the foam midsole component 222F may be advantageous for some purposes (e.g., to provide a high level or improved responsiveness and/or energy return), other options are possible. For example, if desired, rather than defining one or more openings 228 completely through the midsole foam element 222F, blind holes or recesses could be provided rather than openings, and the bladder(s) may be engaged with the foam midsole component 222F in the blind holes or recesses. In such example structures, the bladder(s) may be exposed at either the top surface or the bottom surface of the foam midsole component (e.g., closest to the wearer's foot or further from the wearer's foot). As another option, one or more bladders could be embedded in the polymeric foam midsole component 222F (and thus not exposed at either surface). As yet another example, one or more bladders could be provided in the sole structure 204 at locations separated from (and as part(s) separate from) the midsole foam element 222F (if any). Also, while FIGS. 4A-4F show all four bladders 222*a*-222*d* mounted to a foam midsole element 222F in a common manner, different engagement techniques and/or structures and/or combinations of engagement techniques and/or structures, e.g., of the various types described above, may be used in a single midsole component 220 and/or sole structure 204 without departing from this invention.

In some examples of this invention, the midsole component 220 will be relatively thin, e.g., less than 1 inch thick, through at least 75% (and optionally at least 85% or even at least 95%) of the plantar surface support area (e.g., the thickness from surface 222S to surface 226S). This feature helps provide a low profile midsole component 220.

FIGS. 5A-5C illustrate a sample sole structure 204 made by engaging the midsole component 220 of FIGS. 4A-4F with the ground-engaging component 240 of FIGS. 3A-3C. The parts 220 and 240 may be engaged together in any desired manner without departing from this invention, including through the use of cements or adhesives, mechanical connectors, etc. As illustrated in FIG. 5A (and as generally described above), because of the open matrix structure 250 and the at least partially transparent or at least partially translucent cover 270 provided in the sole structure 204, one or more of the fluid-filled bladders 222*a*-222*d* may be visible through the matrix structure 250 and through the cover 270. If one or more of the bladders 222*a*-222*d* is colored differently from other features of the sole structure 204 (e.g., different from foam midsole element 222F, cover 270, and/or matrix structure 250), the visible bladder 222*a*-222*d* can provide an interesting visual or aesthetic appearance (and help show the technology included in the sole structure 204). The cover 270 can help prevent the fluid-filled bladder(s) 222*a*-222*d* from being punctured or other damage in use.

FIG. 5B further illustrates that the ground-engaging component 240 includes an upwardly extending side wall 240M in the medial midfoot area that extends along and engages the corresponding side wall 226M provided in the foam midsole element 222F. This upwardly extending medial side wall area 240M helps provide additional support for the arch, particularly when combined with the complementary structure of the corresponding side wall 226M provided in the foam midsole element 222F (which helps provide a comfortable feel at the wearer's foot).

Figure 6A:
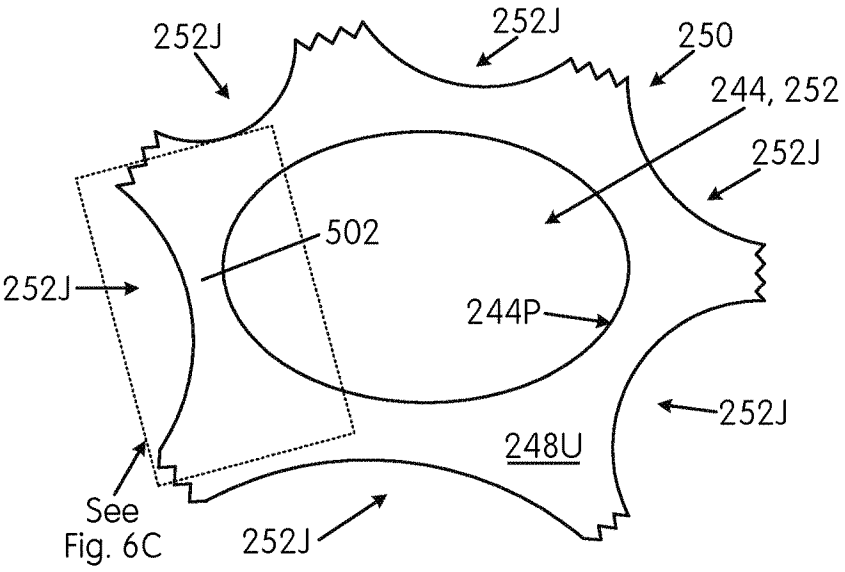
FIGS. 6A-6E provide various views of a matrix structure that may be included in ground-engaging components in accordance with at least some aspects of this invention.
Figure 6B:
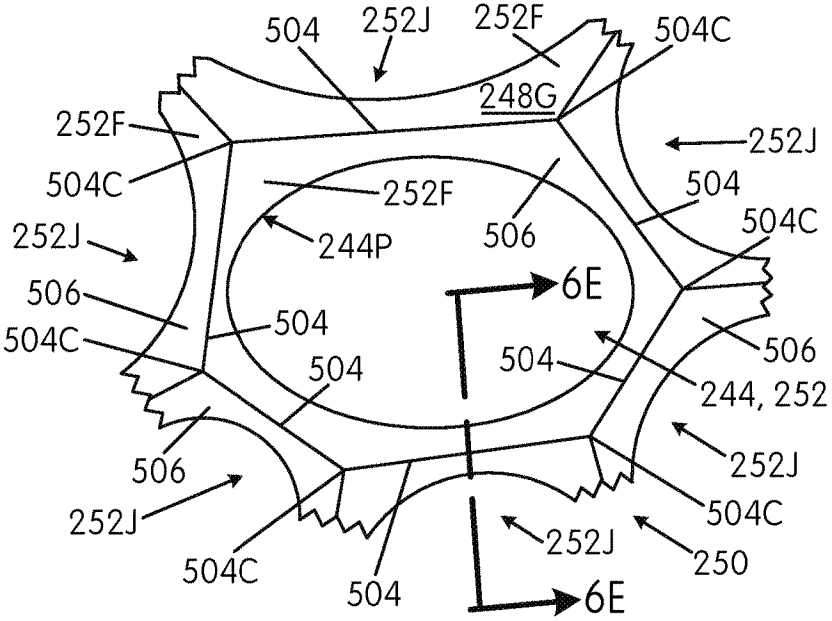
Figure 6D:
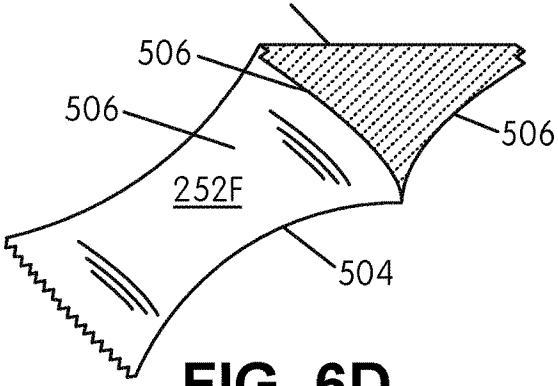
Figure 6E:
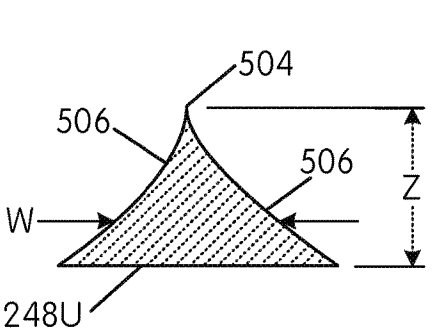
Figure 6C:
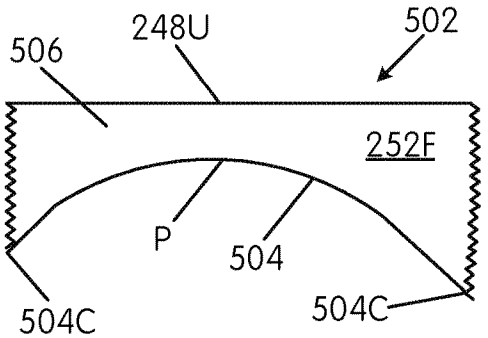

FIGS. 6A through 6E are provided to help illustrate potential features of the matrix structure 250 and the various cells 252 described above. FIG. 6A provides an enlarged top view showing the upper-facing surface 248U at an area around a cell 252 defined by the matrix structure 250 (the space is shown at 244). FIG. 6B shows an enlarged bottom view of this same area of the matrix structure 250 (showing the ground-facing surface 248G). FIG. 6C shows a side view at one leg 502 of the matrix structure 250, and FIG. 6D shows a cross-sectional and partial perspective view of this same leg 502 area. As shown in these figures, the matrix structure 250 provides a smooth top (upper-facing) surface 248U but a more angular ground-facing surface 248G. More specifically, the matrix structure 250 of this illustrated example cell 252 defines a generally hexagonal ridge 504 around the cell 252, with the corners 504C of the hexagonal ridge 504 located at a junction area between three adjacent cells in a generally triangular arrangement (the junction of the cell 252 and two adjacent cells 252J, which may be open, partially open, and/or closed cells, in this illustrated example).

As further shown in these figures, along with FIG. 6E (which shows a sectional view along line 6E-6E of FIG. 6B), the side walls 506 between the upper-facing surface 248U at cell perimeter 244P and the ground-facing surface 248G, which ends at ridge 504 in this example, are sloped. Thus, the overall matrix structure 250, at least at some locations between the generally hexagonal ridge 504 corners 504C, may have a triangular or generally triangular shaped cross section (e.g., see FIGS. 6D and 6E). Moreover, as shown in FIGS. 6C and 6D, the generally hexagonal ridge 504 may be sloped or curved from one corner 504C to the adjacent corners 504C (e.g., with a local maxima point P located between adjacent corners 504C). The side walls 506 may have a generally planar surface (e.g., flat), a partially planar surface (e.g., planar along some of its height/thickness dimension Z), a curved surface (e.g., a concave surface as shown in FIG. 6E), or a partially curved surface (e.g., curved along some of its height dimension Z). As further shown in FIGS. 6D and 6E, a cross sectional width dimension W of the ridge 504 (the dimension from side wall 506 to side wall 506) becomes smaller moving in a direction from the upper-facing surface 248U to the ground-facing surface 248G.

The raised corners 504C of the generally hexagonal ridge 504 in this illustrated example ground-engaging component 240 may be formed as sharp peaks that may act as secondary traction elements at desired locations around the ground-engaging component 240. As evident from these figures and the discussion above, the generally hexagonal ridges 504 and side walls 506 from three adjacent cells (e.g., 252 and two 252J cells) meet at a single (optionally raised) corner 504C and thus may form a substantially pyramid type structure (e.g., a pyramid having three side walls 252F, 506 that meet at a point 504C). This substantially pyramid type structure can have a sharp point (e.g., depending on the slopes of walls 252F, 506), which can function as a secondary traction element when it contacts the ground in use. Note, also, the sharp, pointed secondary traction elements 504C shown in FIGS. 2A and 2B. This same type of pyramid structure formed by matrix 250 also may be used to form the secondary traction elements 264 at cleat support areas 260.

Not every cell 252 (open, partially open, or closed) in the ground-engaging component 240 needs to have this type of sharp, secondary traction element structure (e.g., with raised pointed pyramids at the generally hexagonal ridge 504 corners 504C), and in fact, not every generally hexagonal ridge 504 corner 504C around a single cell 252 needs to have a raised secondary traction element structure. For example, one or more of the ridge components 504 of a given cell 252 may have a generally straight line structure along the ground-facing surface 248G and/or optionally a linear or gently curved structure that moves closer to the upper-facing surface 248U moving from one corner 504C to an adjacent corner 504C. In this manner, sharp/pointed secondary traction elements may be placed at desired locations around the ground-engaging element 240 structure and left out (e.g., with smooth or gently sloped corners 504C and/or edges in the z-direction) at other desired locations. Additionally or alternatively, if desired, raised points and/or other secondary traction elements could be provided at other locations on the matrix structure 250, e.g., anywhere along ridge 504 or between adjacent cells 252. As some more specific examples, at least some (or even all) of the midfoot region 252M (e.g., FIG. 3C) may have no secondary traction elements and/or less prominent secondary traction elements, while other areas (e.g., the heel region 252H, the forefoot region 252F) may include the sharp/pointed secondary traction elements (or more pronounced secondary traction elements) of the types described above.

Notably, in this example construction of FIGS. 6A-6E, the matrix structure 250 defines at least some of the cells 252 (and 252J) such that the perimeter of the entrance to the cell 252 opening around the upper-facing surface 248U (e.g., defined by perimeter 244P of the opening) is smaller than the perimeter of the entrance to the cell 252 opening around the ground-facing surface 248G (e.g., defined by the generally hexagonal perimeter ridge 504). Stated another way, the area of the entrance to the cell 252 opening from the upper-facing surface 248U (e.g., the area within the perimeter 244P of the opening) is smaller than the area of the entrance to the cell 252 opening from the ground-facing surface 248G (e.g., the area within the generally hexagonal perimeter ridge 504). The generally hexagonal perimeter ridge 504 completely defines the lower perimeter in at least some cells 252. These differences in the top and bottom entrance areas and sizes are due to the sloped/curved sides walls 506 from the upper-facing surface 248U to the ground-facing surface 248G in this example.

Hexagonal ridge 504 and/or the secondary traction element structures as described above can be provided in any type of cells (e.g., open cells, partially open cells, closed cells, cells closed by perimeter rim 2420, cells closed by cover 270, etc.). As shown in FIGS. 2D, 3A, and 3C, in at least some examples of this invention, the matrix structure 250 may be integrally formed with the outer perimeter boundary rim 2420 in a manner such that the matrix structure 250 morphs outward and downward from the ground-facing surface 248G of the outer perimeter boundary rim 2420. This may be accomplished, for example, by molding the matrix structure 250 as a unitary, one-piece component with the outer perimeter boundary rim member 2420. Alternatively, the matrix structure 250 could be formed as a separate component that is fixed to the outer perimeter boundary rim member 2420, e.g., by cements or adhesives, by mechanical connectors, etc. As another option, the matrix structure 250 may be made as a unitary, one-piece component with the outer perimeter boundary rim member 2420 by rapid manufacturing techniques, including rapid manufacturing additive fabrication techniques (e.g., 3D printing, laser sintering, etc.) or rapid manufacturing subtractive fabrication techniques (e.g., laser ablation, etc.).

Also, while FIGS. 6A-6E illustrate the cells 252 and secondary traction element features in terms of a hexagonal ridge 504, other polygonal shapes may surround a cell 252 without departing from this invention, including heptagonal shaped ridges, octagonal shaped ridges, nonagonal shaped ridges, decagonal shaped ridges, quadrilateral ridges, triangular ridges, etc. None, all, or some of the corner areas 504C of such other shaped polygonal structures may include secondary traction elements, if desired.

As described above, FIG. 7 provides a close up view of a cleat mount area 260 as well as another example of secondary traction elements 264 at locations around the cleat mount area 260 as well as around cells 252 of the matrix structure. These secondary traction elements 264 are similar to, but shaped somewhat differently, from those described above in conjunction with FIGS. 6A-6E.

FIGS. 8A-8D provide bottom, top, medial side, and partial cross sectional views, respectively, of another example ground-engaging component 840 in accordance with some examples of this invention. While this example ground-engaging component 840 has numerous features in common with the ground-engaging components 240 described above, some noted differences will be highlighted below. When the same reference numbers are used in FIGS. 8A-8C as those used in other figures, those reference numbers are intended to refer to the same or similar parts in structure and/or function as those previously described.

Figure 8A:
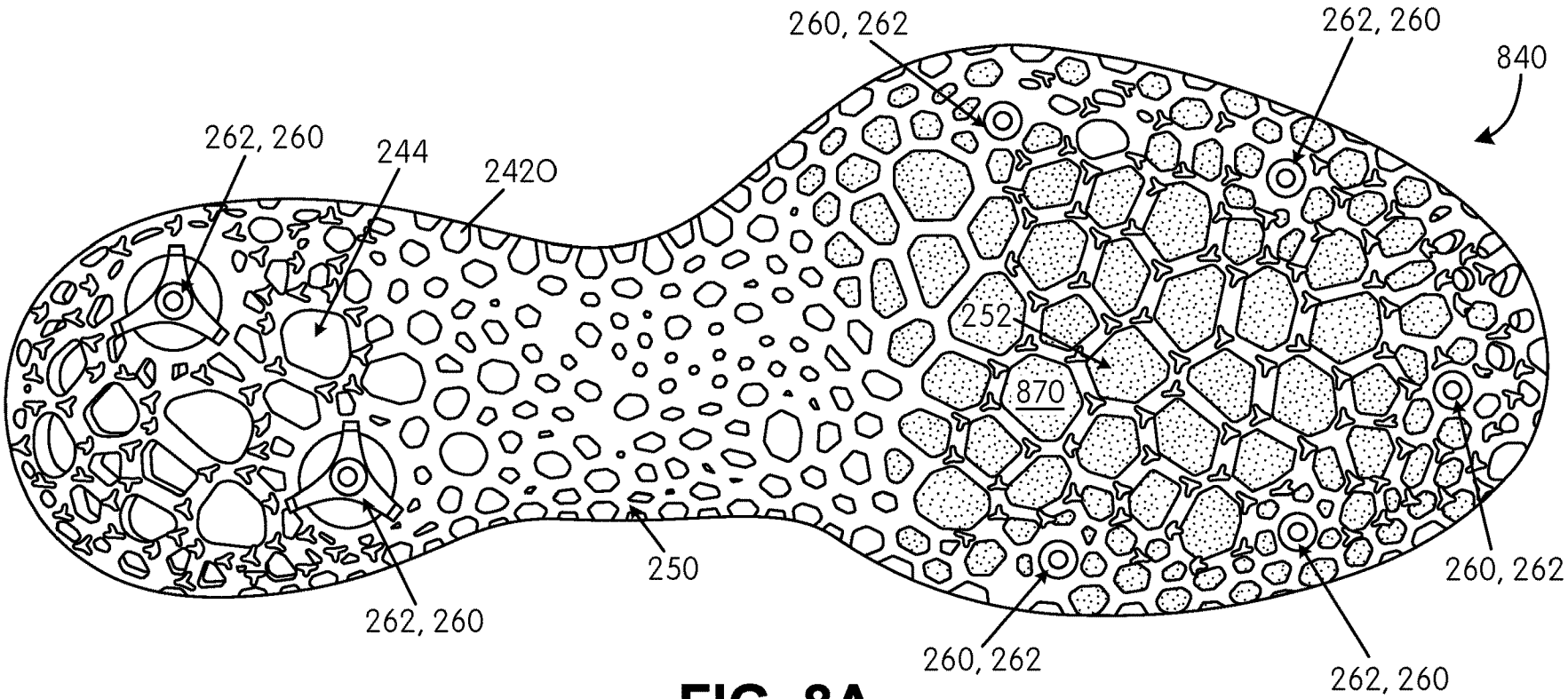
FIGS. 8A-8D provide various views of another example ground-engaging component in accordance with some examples of this invention.
Figure 8B:
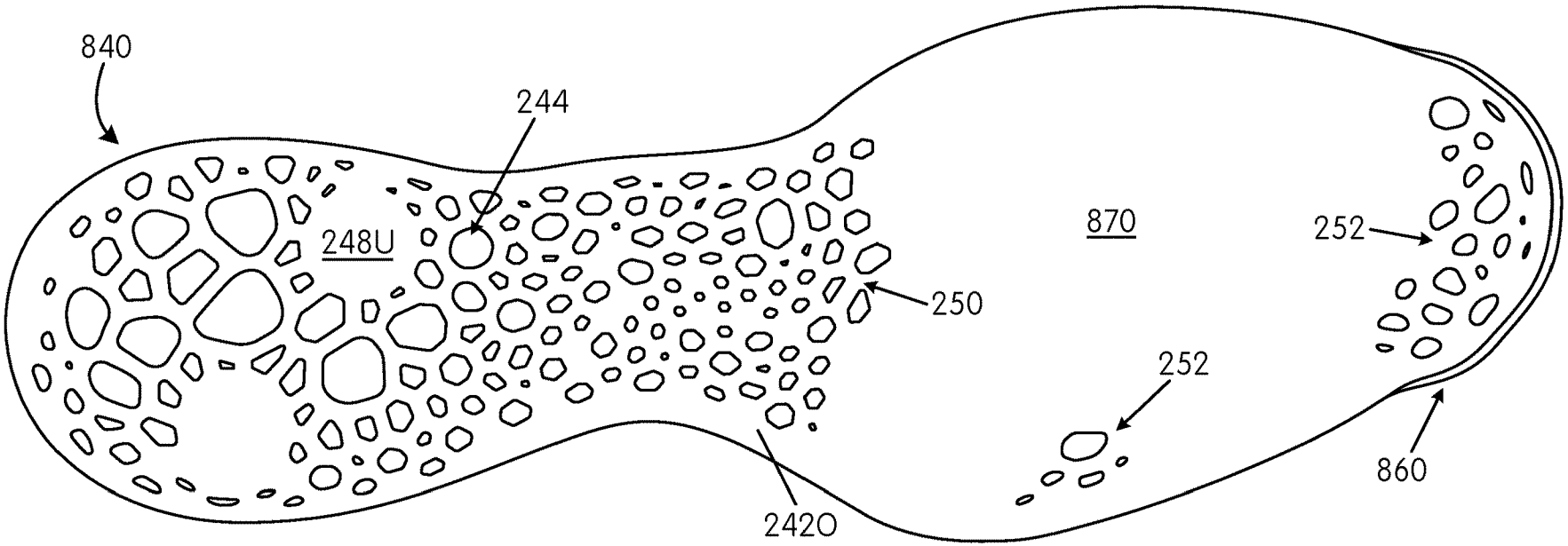

As shown in FIGS. 8A and 8B, the ground-engaging component 840 of this example includes a perimeter rim 2420 that extends at least partially around a perimeter of the ground-engaging component 840, and a matrix support structure 250 extends downwardly from a bottom side of this perimeter rim 2420 and across an open space 244 defined by and located inside the perimeter rim 2420. The ground-engaging component 840 further includes cleat mount areas 260 and/or integrally formed cleats 262 extending from a bottom surface thereof. Also, like the examples described above, this example ground-engaging component 840 includes a raised medial, midfoot side wall 240M, e.g., for providing additional support to the medial midfoot area of the sole structure.

In this example ground-engaging component 840 structure, the cover or support plate 870 is integrally formed with the matrix 250 and outer perimeter boundary rim 2420 structures (and, indeed, the entire ground-engaging component 840 of this example is a unitary, one piece construction). The cover or support plate 870 is located in the forefoot region and is visible and exposed through cells 252 in the matrix structure, as shown in FIG. 8A. In this manner, the cover or support plate 870 closes off at least some of the cells 252 in the forefoot region of this ground-engaging component 840 (and in this illustrated example, a majority of the forefoot region cells 252 are closed, and more specifically, more than 75% or even more than 85% of the forefoot region cells 252 are closed by cover or support plate 870). FIGS. 8A and 8B further show that the forefoot region of this example ground-engaging component 840 includes some open cells 252, e.g., in the forward toe and lateral forefoot area (e.g., near the fifth metatarsal head support area).

The cover or support plate 870 may be integrally formed with the matrix structure 250 and/or the perimeter rim 2420 in any desired manner without departing from this invention, including through molding techniques, rapid manufacturing additive fabrication techniques, and the like. Alternatively, it could be made as a separate part and attached to the matrix structure 250 and/or the perimeter rim 2420, e.g., by adhesives or cements, by mechanical fasteners, etc.

If desired, the cover or support plate 870 may be integrally formed with the matrix structure 250 and/or the outer perimeter boundary rim 2420 in a manner such that, at least at some areas, a top surface 250*t* of the matrix structure 250 is spaced from a bottom surface 870*b* of the cover or support plate 870. This may be accomplished, for example as shown in FIG. 8D, if the cover or support plate 870 is integrally formed with the outer perimeter boundary rim 2420, but the bottom surface 870*b* of the cover or support plate 870 and/or the top surface 250*t* of the matrix structure 250 is shaped so that a gap G is formed between the bottom surface 870*b* of the cover or support plate 870 and/or the top surface 250*t* of the matrix structure 250 (at least at some areas). This type of gap G can help provide some additional soft feel upon foot impacts (e.g., as the top cover 870 deflects to meet the top 250*t* of the matrix structure 250 and close the gap G) and/or improve energy return (e.g., if the top cover 870 is made from a sufficiently resilient material such that it quickly returns to its original shape as impact forces are reduced or removed). Alternatively, this gap G could be omitted and the entire component 840 could be made as a continuous, one-piece construction (e.g., with the cell walls 252W morphing downward from the bottom surface 870*b* of the top cover 870).

In the example ground-engaging component 840 shown in FIGS. 8A and 8B, at least some of the cells 252 of the matrix structure 250 may have curved perimeters with no distinct corners (e.g., as viewed at least from the upper-facing surface 248U shown in FIG. 8B). The open space 244 and/or the matrix structure 250 may extend to all areas of the ground-engaging component 840 within the outer perimeter boundary rim 2420.

Figure 8C:
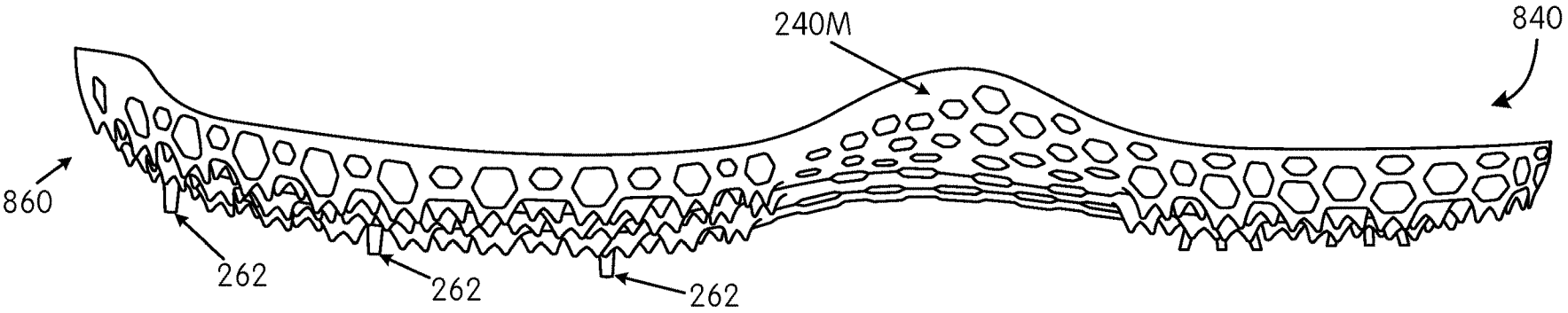
Figure 8D:
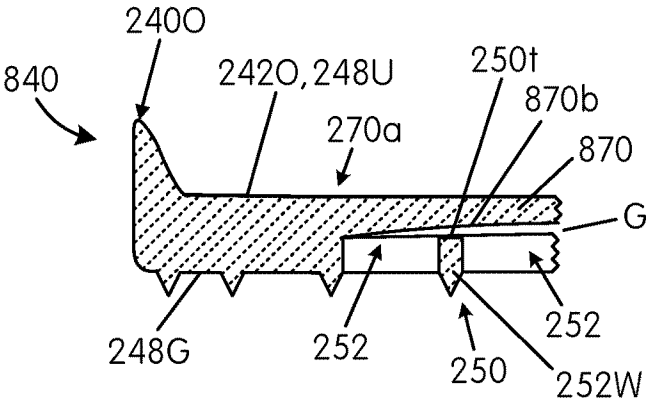

FIGS. 8B and 8C further illustrate that this example ground-engaging component 840 has a somewhat more pronounced end toe cover 860 that helps protect the wearer's toes, helps prevent wear, and/or helps provide durability to the toe end of a midsole component 220 (e.g., a foam midsole element 222F) that may be engaged with the ground-engaging element 840. FIG. 5B illustrates a similar toe cover 860 member on that example ground-engaging component 240.

While the various example ground-engaging components 240, 840 described above feature relatively short rear heel side walls (e.g., configured to contain the bottom of midsole component 220), other options are possible. For example, the heel area of the ground-engaging components 240, 840 may be formed to include a taller heel support, wherein the heel support extends from the upper-facing surface 248U in a direction away from the ground-facing surface 248G and forms a perimeter heel support wall at least at a rear heel area of the ground-engaging components 240, 840. If desired, the perimeter heel support wall could provide the functions of and/or extend to a size akin to a heel counter structure, such as the heel counter 208 shown in FIGS. 2A and 2B. When such a perimeter heel support wall is formed as part of the ground-engaging component 240, 840, this perimeter heel support wall may at least partially contain a sidewall of the midsole member 220 in a heel area of the midsole member 220 and/or at least partially contain a heel area of the upper 202.

As mentioned above, ground-engaging components 240, 840 in accordance with at least some examples of this invention may be made from relatively hard materials, such as thermoplastic polyurethanes, thermosetting polymers, fiber reinforced plastics, poly-ether-block co-polyamide polymers (e.g., of the types available from Atofina Corporation of Puteaux, France under the trademark PEBAX®), etc. The ground-engaging components 240, 840 may be made from materials having a hardness of at least 45 Shore D (and in some examples, at least 50 Shore D, at least 55 Shore D, or even at least 70 Shore D). As some additional potential features, if desired, the cover or support member 270 may have a hardness of at least 45 Shore D (and in some examples, at least 50 Shore D, at least 55 Shore D, or even at least 70 Shore D), and the matrix structure 250 and/or ground-engaging component may have a greater hardness than that of the cover or support member 270 (e.g., at least 50 Shore D, at least 55 Shore D, at least 70 Shore D, at least 80 Shore D, or higher). In some examples, the ground-engaging components 240, 840 may be made from flexible but resilient materials, e.g., materials that will bend under a sufficient impact force but that will tend to quickly return to their original shape once the force is removed or sufficiently relaxed. These features can help provide responsiveness and rebound energy to the wearer's foot.

II. Conclusion

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

What is claimed is:

1. A ground-engaging component for an article of footwear, comprising:

an upper-facing surface, wherein the upper-facing surface defines an outer perimeter boundary rim of the ground-engaging component;

a ground-facing surface opposite the upper-facing surface, wherein at least the ground-facing surface includes a matrix structure, and wherein the matrix structure includes a plurality of open cells and a forefoot region including a plurality of closed forefoot support cells; and a cover member formed as a separate part that overlays a top of the matrix structure, wherein the cover member extends to span and close the plurality of closed forefoot support cells, wherein a boundary line marks a boundary between the cover member and the outer perimeter boundary rim, and wherein the cover member is positioned within a space enclosed by the boundary line.

2. The ground-engaging component according to claim 1, wherein the cover member that closes the plurality of closed forefoot support cells is made, at least in part, from a transparent material, a translucent material, an at least partially transparent material, or an at least partially translucent material.

3. The ground-engaging component according to claim 1, wherein the forefoot region of the matrix structure includes a plurality of open cells.

4. The ground-engaging component according to claim 1, wherein a forward toe area of the forefoot region of the matrix structure includes a plurality of open cells.

5. The ground-engaging component according to claim 1, wherein the matrix structure includes a ridge defining and surrounding at least some of the plurality of open cells and at least some of the plurality of closed forefoot support cells, wherein a cross sectional width dimension of the ridge becomes smaller moving in a direction from the upper-facing surface to the ground-facing surface.

6. The ground-engaging component according to claim 1, wherein the cover member is made from a thermoplastic polyurethane material or a poly-ether-block co-polyamide polymer material.

7. A ground-engaging component for an article of footwear, comprising:

an upper-facing surface; and a ground-facing surface opposite the upper-facing surface, wherein at least the ground-facing surface includes a matrix structure, and wherein the matrix structure includes a plurality of open cells and a forefoot region including a plurality of closed forefoot support cells, and wherein the matrix structure further defines at least six secondary traction elements dispersed around each of one or more of the plurality of closed forefoot support cells, wherein the matrix structure includes a ridge defining and surrounding at least some of the plurality of open cells and at least some of the plurality of closed forefoot support cells and wherein a cross sectional width dimension of the ridge becomes smaller moving in a direction from the upper-facing surface to the ground-facing surface.

8. A sole structure for an article of footwear, comprising:

a midsole component that includes a bottom surface and at least a first fluid-filled bladder, wherein the bottom surface of the midsole component includes a bottom surface of the first fluid-filled bladder; and a ground-engaging member engaged with the bottom surface of the midsole component, wherein the ground-engaging member includes (a) an upper-facing surface, wherein the upper-facing surface defines an outer perimeter boundary rim of the ground-engaging member, (b) a ground-facing surface opposite the upper-facing surface, wherein at least the ground-facing surface includes a matrix structure, wherein the matrix structure includes a plurality of open cells and a forefoot region including a plurality of closed forefoot support cells, and (c) a cover member formed as a separate part that overlays a top of the matrix structure, wherein the cover member extends to span and close the plurality of closed forefoot support cells, wherein a boundary line marks a boundary between the cover member and the outer perimeter boundary rim, and wherein the cover member is positioned within a space enclosed by the boundary line, and wherein the bottom surface of the first fluid-filled bladder is visible through at least some of the plurality of closed forefoot support cells.

9. The sole structure according to claim 8, wherein the midsole component includes a second fluid-filled bladder, wherein the bottom surface of the midsole component includes a bottom surface of the second fluid-filled bladder, and wherein the bottom surface of the second fluid-filled bladder is visible through at least some of the plurality of closed forefoot support cells.

10. The sole structure according to claim 9, wherein the midsole component includes a third fluid-filled bladder, wherein the bottom surface of the midsole component includes a bottom surface of the third fluid-filled bladder, and wherein the bottom surface of the third fluid-filled bladder is visible through at least some of the plurality of closed forefoot support cells.

11. The sole structure according to claim 10, wherein the midsole component includes a fourth fluid-filled bladder, wherein the bottom surface of the midsole component includes a bottom surface of the fourth fluid-filled bladder, and wherein the bottom surface of the fourth fluid-filled bladder is visible through at least some of the plurality of closed forefoot support cells.

12. The sole structure according to claim 8, wherein the cover member is formed from a material that is at least partially transparent or at least partially translucent.

13. A sole structure for an article of footwear, comprising:

a polymeric foam member that includes a plantar support surface and a bottom surface opposite the plantar support surface, wherein the bottom surface of the polymeric foam member includes a first opening having a first sidewall;

a ground-engaging component engaged with the bottom surface of the polymeric foam member, the ground-engaging component including: (a) an upper-facing surface, wherein the upper-facing surface defines an outer perimeter boundary rim of the ground-engaging component, (b) a ground-facing surface opposite the upper-facing surface, wherein at least the ground-facing surface includes a matrix structure, and wherein the matrix structure includes a plurality of open cells and a forefoot region including a plurality of closed forefoot support cells, and (c) a cover member formed as a separate part that overlays a top of the matrix structure, wherein the cover member extends to span and close the plurality of closed forefoot support cells, wherein a boundary line marks a boundary between the cover member and the outer perimeter boundary rim, and wherein the cover member is positioned within a space enclosed by the boundary line; and a first fluid-filled bladder located in the first opening and engaged with the first sidewall, wherein a bottom surface of the first fluid-filled bladder is visible at a bottom surface of the sole structure.

14. The sole structure according to claim 13, wherein the polymeric foam member includes a second opening having a second sidewall, wherein the sole structure further includes a second fluid-filled bladder located in the second opening and engaged with the second sidewall, and wherein a bottom surface of the second fluid-filled bladder is visible at the bottom surface of the sole structure.

15. The sole structure according to claim 14, wherein the polymeric foam member includes: (a) a third opening having a third sidewall, wherein the sole structure further includes a third fluid-filled bladder located in the third opening and engaged with the third sidewall, and wherein a bottom surface of the third fluid-filled bladder is visible at the bottom surface of the sole structure, and (b) a fourth opening having a fourth sidewall, wherein the sole structure further includes a fourth fluid-filled bladder located in the fourth opening and engaged with the fourth sidewall, and wherein a bottom surface of the fourth fluid-filled bladder is visible at the bottom surface of the sole structure.

16. The sole structure according to claim 13, wherein the first opening comprises a through hole or a blind hole that extends upward from the bottom surface of the polymeric foam member.

17. The sole structure according to claim 13, wherein the bottom surface of the first fluid-filled bladder is visible through the ground-engaging component.

18. The sole structure according to claim 17, wherein the cover member is formed from a material that is at least partially transparent or at least partially translucent, and wherein the cover member covers the bottom surface of the first fluid-filled bladder.

19. The sole structure according to claim 13, wherein the cover member is formed from a material that is at least partially transparent or at least partially translucent, and wherein the cover member covers the bottom surface of the first fluid-filled bladder.

* * * * *